US010535303B2

(12) United States Patent
Xiang et al.

(10) Patent No.: US 10,535,303 B2
(45) Date of Patent: Jan. 14, 2020

(54) ORGANIC LIGHT EMITTING DISPLAY PANEL, DRIVING METHOD THEREOF AND ORGANIC LIGHT EMITTING DISPLAY APPARATUS

(71) Applicant: Shanghai Tianma AM-OLED Co., Ltd., Shanghai (CN)

(72) Inventors: Dongxu Xiang, Shanghai (CN); Yue Li, Shanghai (CN); Renyuan Zhu, Shanghai (CN); Tong Wu, Shanghai (CN); Dong Qian, Shanghai (CN); Zeyuan Chen, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/107,971

(22) Filed: Aug. 21, 2018

(65) Prior Publication Data

US 2018/0357959 A1 Dec. 13, 2018

Related U.S. Application Data

(63) Continuation-in-part of application No. 15/629,590, filed on Jun. 21, 2017, now Pat. No. 10,083,659.

(30) Foreign Application Priority Data

Jan. 25, 2017 (CN) ..... 2017 1 0056070

(51) Int. Cl.

| | |
|---|---|
| ***G09G 3/32*** | (2016.01) |
| ***G09G 3/3233*** | (2016.01) |
| ***G09G 3/3258*** | (2016.01) |

(52) U.S. Cl.
CPC ..... *G09G 3/3233* (2013.01); *G09G 3/3258* (2013.01); *G09G 2300/0819* (2013.01); (Continued)

(58) Field of Classification Search
CPC combination set(s) only.
See application file for complete search history.

(56) References Cited

U.S. PATENT DOCUMENTS

2012/0162275 A1 6/2012 Park
2013/0099692 A1* 4/2013 Chaji ..... H05B 37/02 315/224

FOREIGN PATENT DOCUMENTS

CN 104200779 A 12/2014

* cited by examiner

*Primary Examiner* — Van N Chow
(74) *Attorney, Agent, or Firm* — Alston & Bird LLP

(57) ABSTRACT

The present application discloses an organic light emitting display panel, a driving method thereof and an organic light emitting display apparatus. The organic light emitting display panel comprises: a pixel array, comprising pixel regions in M rows and N columns; a plurality of pixel driving circuits each comprising a light emitting diode and a driving transistor for driving the light emitting diode, the light emitting diode being arranged in one of the pixel regions; and a plurality of pixel compensation circuits, each configured to provide a compensated light emitting control signal for a gate of the driving transistor to correct brightness of the light emitting diode in one of the plurality of pixel driving circuits. According to the present disclosure, the final light emitting current may be unrelated to the threshold voltage of the driving transistor, the carrier mobility and aging of the light emitting diode.

11 Claims, 15 Drawing Sheets

(52) U.S. Cl.
CPC ..... *G09G 2300/0852* (2013.01); *G09G 2300/0861* (2013.01); *G09G 2310/0251* (2013.01); *G09G 2310/0262* (2013.01); *G09G 2320/0233* (2013.01); *G09G 2320/043* (2013.01); *G09G 2320/045* (2013.01)

ORGANIC LIGHT EMITTING DISPLAY PANEL, DRIVING METHOD THEREOF AND ORGANIC LIGHT EMITTING DISPLAY APPARATUS

CROSS-REFERENCE TO RELATED APPLICATION

The present application is a continuation-in-part of application Ser. No. 15/629,590, filed Jun. 21, 2017, related to and claims priority from Chinese Patent Application No. CN201710056070.2, filed on Jan. 25, 2017, entitled "Organic Light Emitting Display Panel, Driving Method Thereof, and Organic Light Emitting Display Apparatus," the entire disclosure of which is hereby incorporated by reference for all purposes.

TECHNICAL FIELD

The present disclosure generally relates to the field of display technologies, and more particularly, to an organic light emitting display panel, a driving method thereof and an organic light emitting display apparatus.

BACKGROUND

With the continuous development of display technologies, dimensions of displays change with each passing day. To meet portability of electronic devices, the demand for display screens with smaller dimensions is ever-increasing.

Meanwhile, users put forward higher requirements for the display quality of the display screens. For example, the users are apt to prefer display screens with high Pixels per Inch (PPI) to improve display accuracy, resolution, and coherence.

An organic light emitting diode (OLED) display is more widely used in various portable electronic devices because of its slim and flexible shape, light weight, and power saving features, etc.

The OLED display generally includes an OLED array (namely, a pixel array), driving circuits (namely, pixel circuits) configured to provide driving current for each OLED in the array, and scanning circuits configured to provide drive signals for each pixel circuit.

However, in existing OLED displays, generally, pixel circuits only compensate threshold voltages (Vth) of driving transistors, but no consideration is given to problems of carrier mobility of the driving transistors and aging of light emitting components with the accumulation of service time. For example, as time goes on, when current flows through the light emitting components, forward voltage drop (minimum forward voltage at which the light emitting components can be turned on under assigned forward current) of the light emitting components increases, and the light emitting components generally connect sources/drains of the driving transistors. Therefore, the source to drain voltage difference of the driving transistor diminishes, which may reduce the light emitting current flowing through the light emitting components. However, a plurality of light emitting components and driving transistors are present in the OLED displays, aging degree of each light emitting component and variation degree of the carrier mobility of the driving transistors are different, as a result these light emitting components become different in display brightness even though the same display signal is provided to each pixel circuit, and further cause deterioration of display uniformity of the OLED displays.

SUMMARY

It is desired to provide an organic light emitting display panel, a driving method thereof and an organic light emitting display apparatus, in order to solve the technical problem mentioned above.

In a first aspect, an embodiment of the present disclosure provides an organic light emitting display panel. The organic light emitting display panel includes: a pixel array, including pixel regions in M rows and N columns; a plurality of pixel driving circuits each including a light emitting diode and a driving transistor, the light emitting diode being arranged in each of the pixel regions; and a plurality of pixel compensation circuits, each including a current source signal terminal and an acquisition capacitor. The current source signal terminal provides a current signal to the driving transistor, and the acquisition capacitor is electrically connected to the drive transistor.

In a second aspect, an embodiment of the present disclosure provides a driving method of an organic light-emitting display panel, applicable to drive the above organic light-emitting display panel. The method includes: in a threshold and mobility compensation phase, providing, by the current source signal terminal, a first constant current signal to the driving transistor; and in a light emission phase, proving, by the current source signal terminal, a plurality of current signals with different gray scales to the driving transistor; and driving, by the driving transistor, the light emitting diode to emit light In a third aspect, an embodiment of the present disclosure provides a driving method of an organic light-emitting display panel, applicable to drive the above organic light-emitting display panel. The method includes: in a precharge phase, proving, by the current source signal terminal, a second constant current signal to the driving transistor; in a voltage acquisition phase, feeding back, by the second data signal terminal, a voltage signal of a source of the driving transistor to a respective one of the plurality of pixel compensation circuits; and feeding back, by the fifth constant signal terminal, a voltage signal of a gate of the driving transistor to a respective one of the plurality of pixel compensation circuits; in a data writing phase, writing, by the second data signal terminal, a compensated data signal to the driving transistor; and in a light emission phase, providing, by the sixth constant voltage signal terminal, a constant high voltage signal to the driving transistor; and driving, by the driving transistor, the light emitting diode to emit light.

In a fourth aspect, an embodiment of the present disclosure provides an organic light emitting display apparatus. The organic light emitting display includes the above organic light emitting display panel.

According to the solution of the present disclosure, final light emitting current may be unrelated to threshold voltage of the driving transistor, carrier mobility and aging of the light emitting diode, thereby ensuring display brightness uniformity for the organic light emitting display panel in time dimension and space dimension.

BRIEF DESCRIPTION OF THE DRAWINGS

Other features, objectives and advantages of the present disclosure will become more apparent upon reading the detailed description to non-limiting embodiments with reference to the accompanying drawings.

DETAILED DESCRIPTION OF EMBODIMENTS

The present disclosure will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the invention are shown in the accompanying drawings.

It should also be noted that the embodiments in the present disclosure and the features in the embodiments may be combined with each other on a non-conflict basis. The present disclosure will be described below in detail with reference to the accompanying drawings and in combination with the embodiments.

Figure 1:
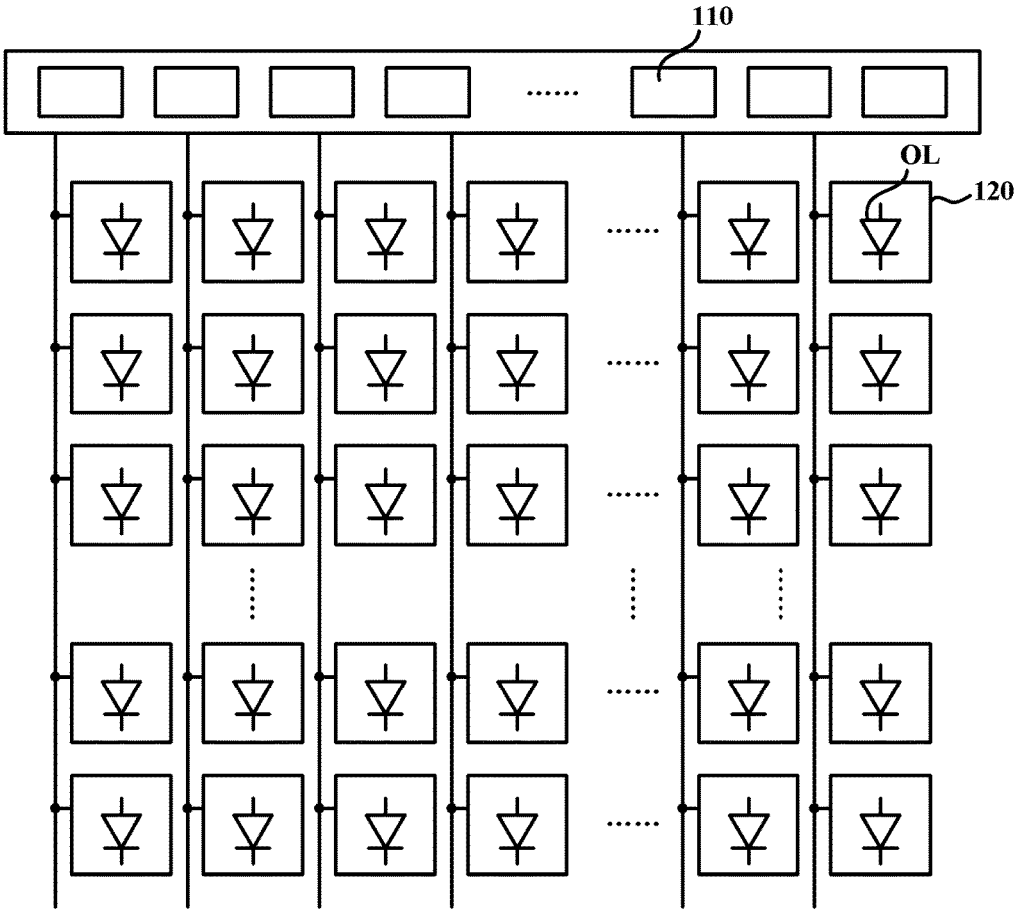
FIG. 1 illustrates a schematic structural diagram of an organic light emitting display panel according to an embodiment of this application.

Referring to FIG. 1, which is a schematic structural diagram of an organic light emitting display panel according to an embodiment of the present disclosure.

The organic light emitting display panel of this embodiment comprises a pixel array, a plurality of pixel driving circuits (not shown in the figure) and a plurality of pixel compensation circuits 110.

The pixel array comprises pixel regions 120 in M rows and N columns. Each pixel driving circuit may comprise a light emitting diode OL and a driving transistor (not shown in the figure) configured to drive the light emitting diode OL. One light emitting diode is arranged in each pixel region 120. In some optional implementations, the pixel driving circuit may be arranged in each pixel region 110. The light emitting diodes in the corresponding pixel region 110 may display corresponding brightness by controlling on or off of the driving transistors in the pixel region 110.

The pixel compensation circuit 110 may be configured to provide a compensated light emitting control signal for a gate of the driving transistor to correct brightness of each light emitting diode OL.

In the following, the principle of the pixel compensation circuit of this embodiment will be described in combination with FIG. 2.

Figure 2:
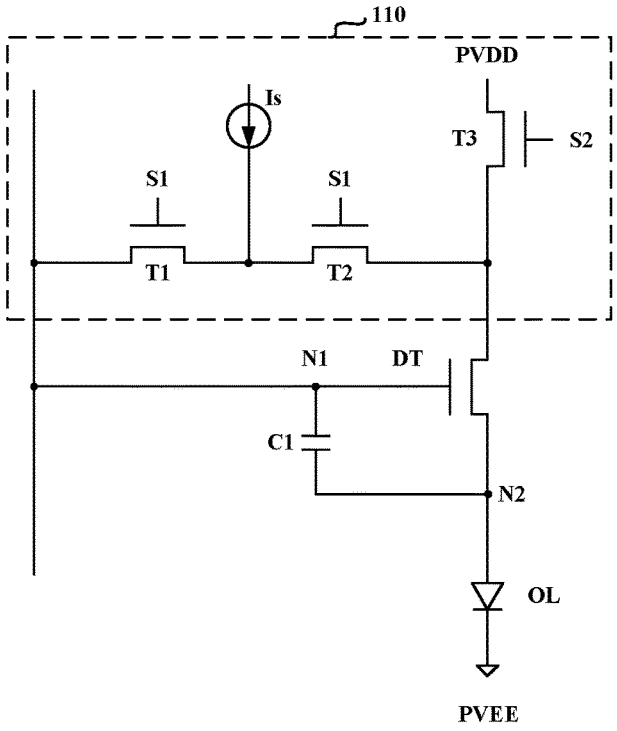
FIG. 2 illustrates a schematic diagram of a connection relationship between a pixel driving circuit and a pixel compensation circuit in an organic light emitting display panel according to an embodiment of the present disclosure.

FIG. 2 illustrates a schematic diagram of a connection relationship between a pixel driving circuit and a pixel compensation circuit in an organic light emitting display panel according to an embodiment of the present disclosure.

In FIG. 2, the pixel compensation circuit comprises a current source Is, a first transistor T1, a second transistor T2 and a third transistor T3. A gate of the first transistor T1 and a gate of the second transistor T2 are electrically connected with a first control signal terminal S1. A first electrode of the first transistor T1 and a first electrode of the second transistor T2 are electrically connected with an output terminal of the current source Is. A second electrode of the first transistor T1 is electrically connected with the gate (a node N1) of the driving transistor DT, and a second electrode of the second transistor T2 is electrically connected with a second electrode of the third transistor T3. A gate of the third transistor T3 is electrically connected with the second control signal terminal S2, a first electrode of the third transistor T3 is electrically connected with a first voltage signal terminal PVDD, and a second electrode of the third transistor T3 is electrically connected with a first electrode of the driving transistor DT. In addition, as shown in FIG. 2, the second electrode (a node N2) of the driving transistor DT is electrically connected with an anode of the light emitting diode OL, and a cathode of the light emitting diode OL is electrically connected with a second voltage signal terminal PVEE. The pixel driving circuit further comprises a first capacitor C1, a first end of the first capacitor C1 is electrically connected with the gate of the driving transistor DT, and a second end of the first capacitor C1 is electrically connected with a second electrode of the driving transistor DT and the anode of the light emitting diode OL.

In this way, current generated by the current source Is may be supplied to the node N1 and the node N2 by controlling a control signal of the first control signal terminal S1 and the second control signal terminal S2. In addition, the light emitting diode OL may be controlled to emit light by controlling the control signal of the second control signal terminal S2. Current generated by the current source Is may be directly supplied to the node N1 and the node N2, and voltages of the node N1 and the node N2 are fixed in the phase of writing the data voltage signal by means of the current source Is. Furthermore, the first capacitor C1 is connected between the node N1 and the node N2, based on a coupling action of the capacitor, in the light emission phase, the voltage of the node N1 synchronizes with the voltage of the node N2. Therefore, the voltage difference between the node N1 and the node N2 remains unchanged. As can be seen from the above analysis, as long as the current source Is supplies light emitting current corresponding to each display gray scale to each pixel driving circuit via the pixel compensation circuit 110, the light emitting diode OL in each pixel driving circuit may be ensured to emit light of corresponding brightness, and the light emitting brightness may be merely related to the magnitude of the light emitting current supplied by the current source but unrelated to the threshold voltage of the driving transistor DT, the carrier mobility and the aging degree of the light emitting diode OL (namely, the I-V curve of the light emitting diode OL), wherein the I-V curve is the volt-ampere characteristic curve, where I is the light emitting current, and V is the anode voltage.

Figure 3:
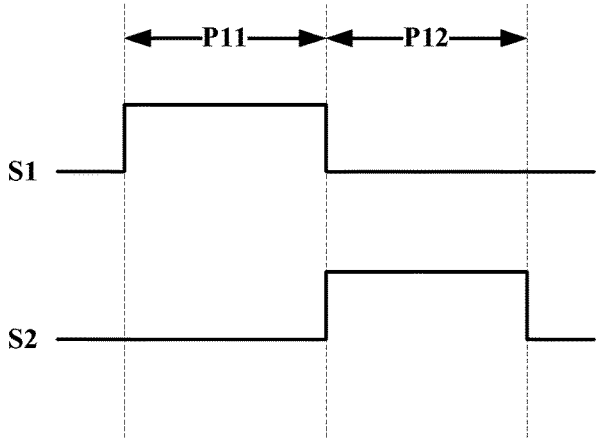
FIG. 3 illustrates a schematic timing sequence of each drive signal used in FIG. 2.

In the following, assume, as an example, each transistor is an NMOS transistor, the working principle of the pixel compensation circuit of this embodiment is further schematically described in combination with the driving time sequence as shown in FIG. 3, so as to highlight technical effects of the pixel compensation circuit of this embodiment.

Specifically, in a data writing phase P11, the current source Is outputs light emitting current corresponding to display brightness according to the display brightness required for a current display picture. At this moment, to supply the light emitting current to the node N1 and the node N2, the first control signal terminal S1 provides a high level signal while the second control signal terminal S2 provides a low level signal. Thus, both the first transistor T1 and the second transistor T2 are turned on under the control of the high voltage level signal, and a light emitting current signal is supplied to the node N1 and the node N2 respectively via the first transistor T1 and the second transistor T2. After stabilization, no current flows through the node N1. At this moment, light emitting current outputted by the current source is totally supplied to the node N2, and voltages of the node N1 and the node N2 are fixed.

Next, in a light emission phase P12, the first control signal terminal S1 provides a low voltage level signal while the second control signal terminal S2 provides a high level signal. As thus, both the first transistor T1 and the second transistor T2 are turned off under the control of the low voltage level signal, and the third transistor T3 is turned on under the control of the high voltage level signal. As the light emitting current flows to the light emitting diode OL, the voltage of the node N2 may be further pulled up under the action of the first voltage signal VDD provided by the first voltage signal terminal PVDD. Meanwhile, the node N1 is in a suspension state because the first transistor T1 is turned off. Under the coupling action of the first capacitor C1, the voltage of the node N1 will synchronously vary with the voltage of the node N2, so that the voltage difference between the node N1 and the node N2 remains unchanged. In this way, it is ensured that the light emitting current is stable and the brightness of the light emitting diode OL maintains constant.

As can be seen from the above description, in this embodiment, as long as the current source Is supplies light emitting current corresponding to each display gray scale to each pixel driving circuit via the pixel compensation circuit 110, the light emitting diode OL in each pixel driving circuit may be ensured to emit light of corresponding brightness, and the light emitting brightness may be merely related to the magnitude of the light emitting current supplied by the current source but unrelated to the threshold voltage of the driving transistor DT, the carrier mobility and the aging degree of the light emitting diode OL (namely, the I-V ratio of the light emitting diode OL). Therefore, no matter how the threshold voltage of each driving transistor DT in the organic light emitting display panel and the carrier mobility vary, and no matter what the aging degree of each light emitting diode OL in the organic light emitting display panel is, by using the pixel compensation circuit of this embodiment, uniform display of each display brightness in each region of the organic light emitting display panel may be implemented, thereby enhancing the display brightness uniformity for the organic light emitting display panel.

In addition, in some optional implementations, to avoid the light emitting diode OL from being lighted in the above-described data writing phase P11, in the data writing phase P11, a higher voltage signal may be supplied to the second voltage signal terminal PVEE connected with the cathode of the light emitting diode OL, so as to prevent the light emitting diode OL from being turned on in this phase.

Figure 4:
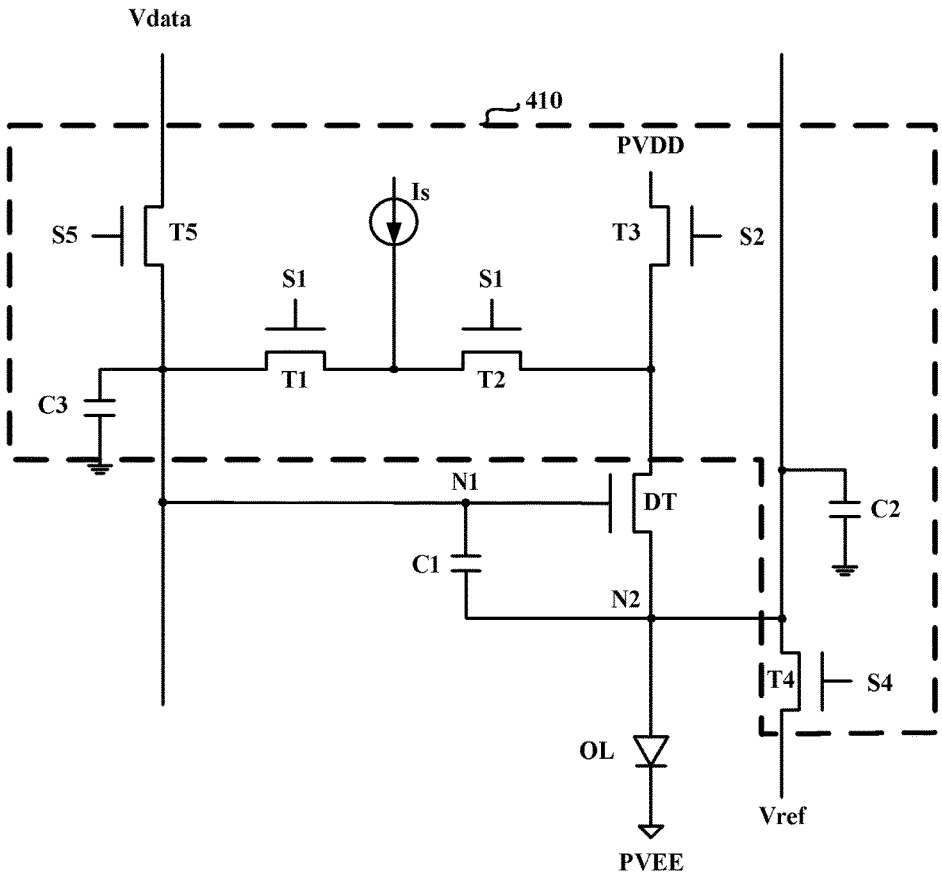
FIG. 4 illustrates a schematic diagram of a connection relationship between a pixel driving circuit and a pixel compensation circuit in an organic light emitting display panel according to another embodiment of the present disclosure.

Referring to FIG. 4, which illustrates a schematic diagram of a connection relationship between a pixel driving circuit and a pixel compensation circuit in an organic light emitting display panel according to another embodiment of the present disclosure.

Similar to the embodiment as shown FIG. 2, in this embodiment, the pixel driving circuit likewise comprises the driving transistor DT, the light emitting diode OL and the first capacitor C1. The pixel compensation circuit 410 likewise comprises the current source Is, the first transistor T1, the second transistor T2 and the third transistor T3. The connection relationship among these components is similar to the embodiment as shown in FIG. 2.

Different from the embodiment as shown in FIG. 2, in this embodiment, the pixel compensation circuit 410 further comprises a second acquisition capacitor C2, a third acquisition capacitor C3, a fourth transistor T4 and a fifth transistor T5.

A first end of the third acquisition capacitor C3 is electrically connected with the second electrode of the first transistor T1, and a second end of the third acquisition capacitor C3 is grounded.

A gate of the fourth transistor T4 is electrically connected with a fourth control signal terminal S4, a first electrode of the fourth transistor T4 is electrically connected with a first end of the second acquisition capacitor C2, a second electrode of the fourth transistor T4 is electrically connected with a reference voltage signal line, and a second end of the second acquisition capacitor C2 is grounded.

A gate of the fifth transistor T5 is electrically connected with a fifth control signal terminal S5, a first electrode of the fifth transistor T5 is electrically connected with a data line Vdata, and a second electrode of the fifth transistor T5 is electrically connected with the second electrode of the first transistor T1.

As thus, the current source Is of the pixel compensation circuit 410 may output a reference current signal to the node N1 and the node N2 of the pixel driving circuit. The voltage of the node N1 is acquired by the third acquisition capacitor C3, and the voltage of the node N2 is acquired by the second acquisition capacitor C2. A certain numerical relationship exists among the light emitting current, the difference Vgs between the gate voltage (namely, the voltage of the node N1) and the source voltage (namely, the voltage of the node N2) of the driving transistor DT, the carrier mobility of the driving transistor DT and the threshold voltage of the driving transistor DT, and the reference current signal outputted by the current source Is is a known numerical value. Therefore, by repeatedly acquiring the voltage of the node N1 and the voltage of the node N2, the carrier mobility and the threshold voltage of the driving transistor DT may be determined correspondingly. Meanwhile, the I (flow current)-V (anode voltage) ratio of the light emitting diode OL may be worked out by means of the voltage of the node N2 and the reference current signal outputted by the current source Is.

As can be seen from the above analysis, by acquiring the gate voltage (the voltage of the node N1) of the driving transistor DT and the anode voltage (the voltage of the node N2) of the light emitting diode OL, the pixel compensation circuit 410 may determine the current carrier mobility and the threshold voltage of the driving transistor DT and the I-V ratio of the light emitting diode OL in the pixel driving circuit in the event that the light emitting current (namely, the reference current outputted by the current source Is) flowing through the light emitting diode OL is known. As thus, a compensation signal may be determined according to the gate voltage (the voltage of the node N1) of the driving transistor DT, the anode voltage of the light emitting diode OL and the known light emitting current (namely, the reference current outputted by the current source Is) flowing through the light emitting diode OL. When a data voltage signal is applied to each pixel driving circuit, the data voltage signal applied to each pixel driving circuit is compensated by using the compensation signal, so as to enhance the display brightness uniformity for the whole organic light emitting display panel.

Figure 5:
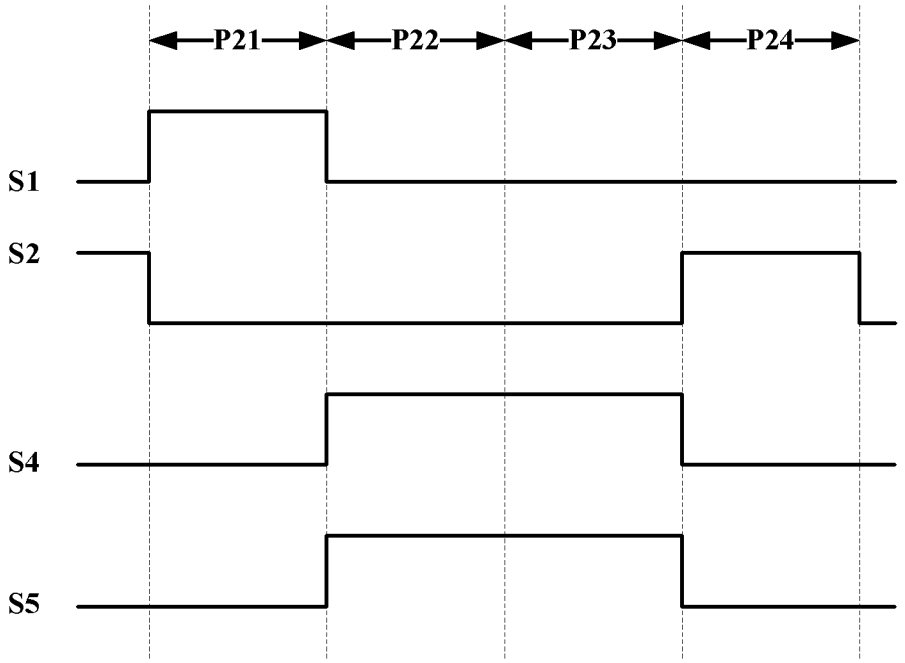
FIG. 5 illustrates a schematic timing sequence of each drive signal used in FIG. 4.

In the following, the working principle of the pixel compensation circuit in this embodiment will be further described with reference to the timing diagram as shown in FIG. 5. In the following description, a description is schematically made taking each transistor in FIG. 4 as an NMOS transistor.

Specifically, in a precharge phase P21, the first control signal terminal S1 inputs a high voltage level signal, and the second control signal terminal S2, the fourth control signal terminal S4 and the fifth control signal terminal S5 input a low voltage level signal. At this moment, the first transistor T1 and the second transistor T2 are turned on, the current source Is outputs a known reference current signal and supplies the reference current signal to the gate of the driving transistor DT and the anode of the light emitting diode OL. After the second acquisition capacitor C2 and the third acquisition capacitor C3 are continuously charged, after stabilization, no current flows through the gate of the driving transistor DT. At this moment, the reference current signal outputted by the current source Is totally flows to the anode (node N2) of the light emitting diode OL.

Next, in a voltage acquisition phase P22, the first control signal terminal S1 and the second control signal terminal S2 input a low voltage level signal, and the fourth control signal terminal S4 and the fifth control signal terminal S5 input a high voltage level signal. At this moment, the fourth transistor T4 and the fifth transistor T5 are turned on. As thus, the voltage VN1 of the node N1 stored in the third acquisition capacitor C3 in the precharge phase P21 may be acquired via a data line Vdata, and the voltage VN2 of the node N2 stored in the second acquisition capacitor C2 in the precharge phase P21 may be acquired via the reference voltage signal line Vref.

When the driving transistor DT is in a saturation region, current Ids may be determined according to following Formula (1):

$$Ids=1/2\mu C_{ox}W/L(Vgs-|Vth|)^2 \quad (1),$$

wherein μ is the carrier mobility of the driving transistor DT;

$C_{ox}$ is a capacitance value of a gate oxide layer capacitor per unit area of the driving transistor DT, which is a fixed value;

Vgs is a difference between the gate voltage Vg (namely, the voltage VN1 of the node N1) of the driving transistor DT and a source voltage Vs (namely, the voltage VN2 of the node N2);

W/L is a width-to-length ratio of the driving transistor DT, which is a fixed value; and Vth is the threshold voltage of the driving transistor DT.

In the precharge phase, the current outputted by the current source Is is a known quantity, in the above Formula (1), Ids, Cox, and Vgs=VN1−VN2 are known. Unknown quantities comprise the carrier mobility μ of the driving transistor DT and the threshold voltage Vth of the driving transistor DT.

As thus, through twice precharge, that is, the current source Is outputs two different reference current signals, and the third acquisition capacitor C3 and the second acquisition capacitor C2 acquire the voltage VN1 of the node N1 and the voltage VN2 of the node N2 twice. In this way, two equations in regard to the carrier mobility μ of the driving transistor DT and the threshold voltage Vth of the driving transistor DT may be obtained. Based on the simultaneous equations, the carrier mobility μ of the driving transistor DT and the threshold voltage Vth of the driving transistor DT may be worked out.

In another aspect, the voltage VN2 of the node N2 is acquired by the second acquisition capacitor C2, and the light emitting current is the known reference current signal outputted by the current source Is. Therefore, an I-V ratio of the light emitting diode OL may be correspondingly worked out. Further, a corresponding relationship among the display brightness, the light emitting current Ids and the anode voltage of the light emitting diode OL is determined.

By means of the above precharge phase P21 and the voltage acquisition phase P22, the carrier mobility μ of the driving transistor DT, the threshold voltage Vth of the driving transistor DT, and the corresponding relationship between the light emitting current and brightness of the current light emitting diode OL may be worked out, so as to obtain the compensated data voltage signal by compensating the data voltage signal. Specifically, when it is expected that a light emitting diode within a certain pixel region displays certain brightness, a numerical value of the light emitting current may be determined according to the corresponding relationship between the display brightness and the light emitting current, and then the light emitting current Ids, the μ, the Vth, the Cox and the W/L are substitute into the above Formula (1). In this way, the numerical value of the Vgs may be obtained by an inverse solution. Additionally, Vgs=Vdata−Vs, the Vs may be obtained by means of a volt-ampere characteristic curve (namely, the I-V ratio) of the light emitting diode OL, and finally the compensated numerical value of the Vdata may be obtained.

Next, in a data writing phase P23, the first control signal terminal S1 and the second control signal terminal S2 input a low voltage level signal, and the fourth control signal terminal S4 and the fifth control signal terminal S5 input a high voltage level signal. The compensated data voltage signal is supplied to the gate of the driving transistor DT via the data voltage signal line Vdata, and the reference voltage signal is supplied to the anode of the light emitting diode OL via the fourth transistor T4 through the reference voltage signal line Vref.

Finally, in a light emission phase P24, the first control signal terminal S1, the fourth control signal terminal S4 and the fifth control signal terminal S5 input a low voltage level signal, the second control signal terminal S2 inputs a high voltage level signal, and the light emitting diode OL emits light based on the compensated data voltage signal written into the gate of the driving transistor DT in the data writing phase P23.

As thus, the threshold voltage of the driving transistor DT, the carrier mobility and aging of the light emitting diode OL may be compensated by means of the pixel compensation circuit 410, thereby ensuring display brightness uniformity for the organic light emitting display panel in time dimension and space dimension.

Specifically, the pixel compensation circuit 410 of this embodiment compensates the threshold voltage of the driving transistor DT and the carrier mobility, which may avoid a problem that the display brightness obtained by providing the same data voltage signal to these driving transistors may be different due to difference in the threshold voltage of the driving transistor and the carrier mobility resulted from distinction of manufacturing processes, thereby implementing display brightness uniformity in space (namely, in different regions of the panel).

In another aspect, the pixel compensation circuit 410 of this embodiment also compensates aging of the light emitting diode OL, which avoids a problem that the brightness is lower and lower as time goes on when the light emitting diode OL receives the same anode voltage, thereby implementing display brightness uniformity in time dimension.

In some optional implementations, the organic light emitting display panel of this embodiment may further comprise an integrated circuit (not shown in the figure). The first end of the third acquisition capacitor C3 is electrically connected with the integrated circuit, and the first end of the second acquisition capacitor C2 is electrically connected with the integrated circuit. As thus, the third acquisition capacitor C3 may transmit the acquired voltage of the node N1 to the integrated circuit, and the second acquisition capacitor C2 also may transmit the acquired voltage of the node N2 to the integrated circuit. The integrated circuit may determine the threshold voltage of the driving transistor DT, the carrier mobility and the I-V ratio of the light emitting diode according to the acquired voltage signal.

In these optional implementations, for example, the numerical value of Vdata corresponding to each level of brightness may be stored in a memory of the integrated circuit. When a certain level of brightness needs to be displayed, the integrated circuit may read the numerical value of data voltage corresponding to the brightness in the memory, and provide the numerical value of data voltage to a corresponding pixel driving circuit.

Figure 6:
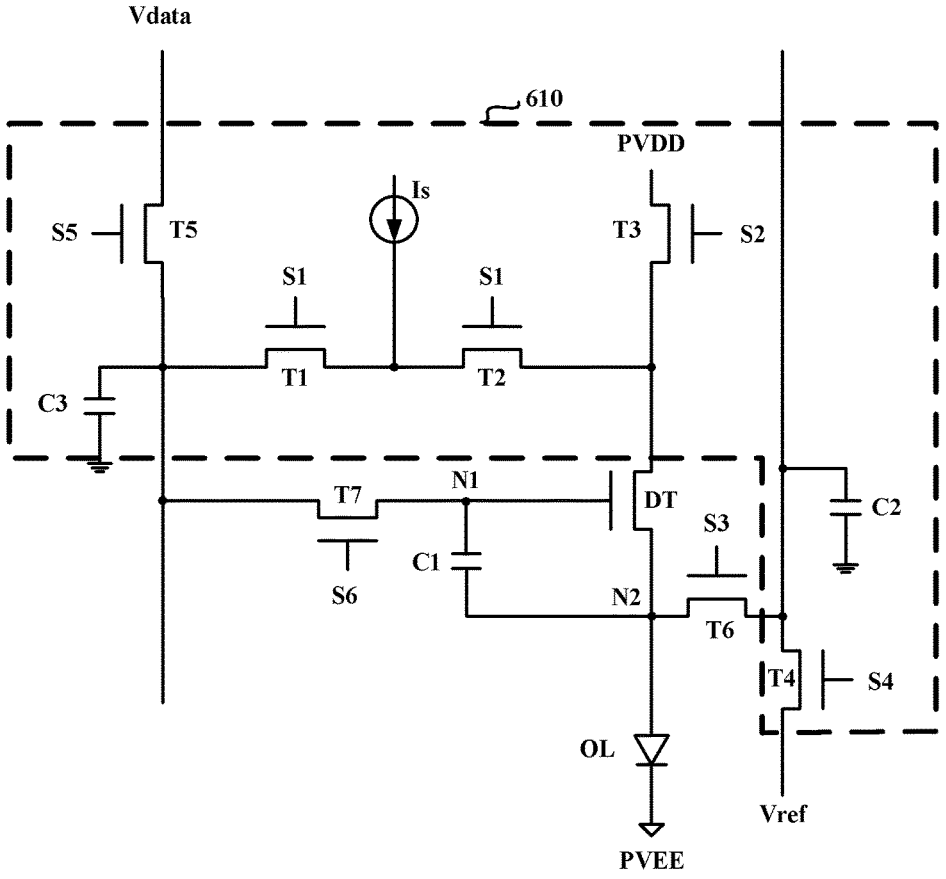
FIG. 6 illustrates a schematic diagram of a connection relationship between a pixel driving circuit and a pixel compensation circuit in an organic light emitting display panel according to still another embodiment of the present disclosure.

Referring to FIG. 6, which illustrates a schematic diagram of a connection relationship between a pixel driving circuit and a pixel compensation circuit in an organic light emitting display panel according to another embodiment of the present disclosure.

Similar to FIG. 4, in this embodiment, the pixel driving circuit likewise comprises the driving transistor DT, the light emitting diode OL and the first capacitor C1. The pixel compensation circuit likewise comprises the current source Is, the first transistor T1, the second transistor T2, the third transistor T3, the fourth transistor T4, the fifth transistor T5, the second acquisition capacitor C2 and the third acquisition capacitor C3. The connection relationship among these components is similar to the embodiment as shown in FIG. 4.

Different from the embodiment as shown in FIG. 4, in this embodiment, the pixel driving circuit may further comprise a sixth transistor T6 and a seventh transistor T7.

A gate of the sixth transistor T6 is electrically connected with a third control signal terminal S3, a first electrode of the sixth transistor T6 is electrically connected with the anode of the light emitting diode OL, and a second electrode of the sixth transistor T6 is electrically connected with a reference voltage signal line Vref.

A gate of the seventh transistor T7 is electrically connected with a sixth control signal terminal S6, a first electrode of the seventh transistor T7 is electrically connected with the second electrode of the first transistor T1, and a second electrode of the seventh transistor T7 is electrically connected with the gate of the driving transistor DT.

As thus, each pixel driving circuit corresponding to a column of pixel regions is electrically connected with the same pixel compensation circuit, so that the same pixel compensation circuit may compensate, based on time sharing, the threshold voltage of the driving transistor in each pixel driving circuit of the same column of pixel regions, the carrier mobility and aging of the light emitting diode.

Figure 7:
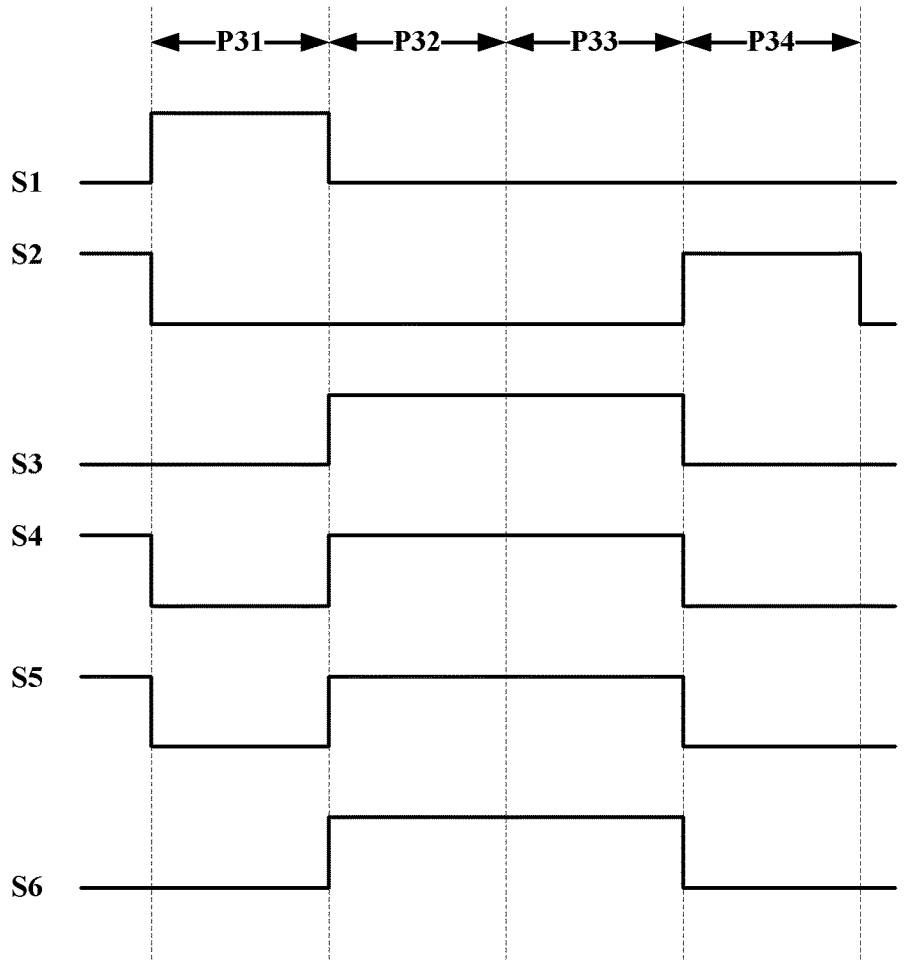
FIG. 7 illustrates a schematic timing sequence of each drive signal used in FIG. 6.

In the following, the working principle of the pixel compensation circuit in this embodiment will be further described with reference to the timing diagram as shown in FIG. 7. In the following description, a description is schematically made taking each transistor in FIG. 6 as an NMOS transistor.

Specifically, in a precharge phase P31, the first control signal terminal S1, the third control signal terminal S3 and the sixth control signal terminal S6 input a high voltage level signal, and the second control signal terminal S2, the fourth control signal terminal S4 and the fifth control signal terminal S5 input a low voltage level signal. At this moment, the first transistor T1, the second transistor T2, the sixth transistor T6 and the seventh transistor T7 are turned on, the current source Is outputs a known reference current signal and supplies the reference current signal to the gate of the driving transistor DT and the anode of the light emitting diode OL. After stabilization, no current flows through the gate of the driving transistor DT. At this moment, the reference current signal outputted by the current source Is totally flows to the anode of the light emitting diode OL. Meanwhile, the third acquisition capacitor C3 may acquire and store the voltage VN1 of the node N1. The second acquisition capacitor C2 may acquire and store the voltage VN2 of the node N2 because the sixth transistor T6 is turned on.

Next, in a voltage acquisition phase P32, the first control signal terminal S1, the second control signal terminal S2, the third control signal terminal S3 and the sixth control signal terminal S6 input a low voltage level signal, and the fourth control signal terminal S4 and the fifth control signal terminal S5 input a high voltage level signal. At this moment, the fourth transistor T4 and the fifth transistor T5 are turned on. As thus, the voltage VN1 of the node N1 stored in the third acquisition capacitor C3 in the precharge phase P31 may be acquired via a data line Vdata, and the voltage VN2 of the node N2 stored in the second acquisition capacitor C2 in the precharge phase P31 may be acquired via the reference voltage signal line Vref.

When the driving transistor DT is in a saturation region, current Ids may be determined according to the above Formula (1). In the precharge phase, the current outputted by the current source Is is a known quantity, in the above Formula (1), Ids, Cox, and Vgs=VN1−VN2 are known. Unknown quantities comprise the carrier mobility p of the driving transistor DT and the threshold voltage Vth of the driving transistor DT.

As thus, through twice precharge, that is, the current source Is outputs two different reference current signals, and the third acquisition capacitor C3 and the second acquisition capacitor C2 acquire the voltage VN1 of the node N1 and the voltage VN2 of the node N2 twice. In this way, two equations in regard to the carrier mobility μ of the driving transistor DT and the threshold voltage Vth of the driving transistor DT may be obtained. Based on the simultaneous equations, the carrier mobility p of the driving transistor DT and the threshold voltage Vth of the driving transistor DT may be worked out.

In another aspect, the voltage VN2 of the node N2 is acquired by the second acquisition capacitor C2, and the light emitting current is the known reference current signal outputted by the current source Is. Therefore, an I-V ratio of the light emitting diode OL may be correspondingly worked out. Further, a corresponding relationship among the display brightness, the light emitting current Ids and the anode voltage of the light emitting diode OL is determined.

By means of the above precharge phase P31 and the voltage acquisition phase P32, the carrier mobility μ of the driving transistor DT, the threshold voltage Vth of the driving transistor DT, and the corresponding relationship between the light emitting current and brightness of the current light emitting diode OL may be worked out, so as to obtain the compensated data voltage signal by compensating the data voltage signal. Specifically, when it is expected that a light emitting diode within a certain pixel region displays certain brightness, a numerical value of the light emitting current may be determined according to the corresponding relationship between the display brightness and the light emitting current, and then the light emitting current Ids, the p, the Vth, the Cox and the W/L are substitute into the above Formula (1). In this way, the numerical value of the Vgs may be obtained by an inverse solution. Additionally, Vgs=Vdata−Vs, the Vs may be obtained by means of a volt-ampere characteristic curve (namely, the I-V ratio) of the light emitting diode OL may be obtained via the Vs, and finally the compensated numerical value of the Vdata may be obtained.

Next, in a data writing phase P33, the first control signal terminal S1 and the second control signal terminal S2 input a low voltage level signal, and the third control signal terminal S3, the fourth control signal terminal S4, the fifth control signal terminal S5 and the sixth control signal terminal S6 input a high voltage level signal. The compensated data voltage signal is supplied to the gate of the driving transistor DT via the seventh transistor T7 through the data voltage signal line Vdata, and the reference voltage signal is supplied to the anode of the light emitting diode OL via the sixth transistor T6 through the reference voltage signal line Vref.

Finally, in a light emission phase P34, the first control signal terminal S1, the third control signal terminal S3, the fourth control signal terminal S4, the fifth control signal terminal S5 and the sixth control signal terminal S6 input a low voltage level signal, the second control signal terminal S2 inputs a high voltage level signal, and the light emitting diode OL emits light based on the compensated data voltage signal written into the gate of the driving transistor DT in the data writing phase P33.

As thus, the threshold voltage of the driving transistor DT, the carrier mobility and aging of the light emitting diode OL may be compensated by means of the pixel compensation circuit 610, thereby ensuring display brightness uniformity for the organic light emitting display panel in time dimension and space dimension.

Specifically, the pixel compensation circuit 610 of this embodiment compensates the threshold voltage of the driving transistor DT and the carrier mobility, which may avoid a problem that the display brightness obtained by providing the same data voltage signal to these driving transistors may be different due to difference in the threshold voltage of the driving transistor and the carrier mobility resulted from distinction of manufacturing processes, thereby implementing display brightness uniformity in space (namely, in different regions of the panel).

In another aspect, the pixel compensation circuit 610 of this embodiment also compensates aging of the light emitting diode OL, which avoids a problem that the brightness is lower and lower as time goes on when the light emitting diode OL receives the same anode voltage, thereby implementing display brightness uniformity in time dimension.

It is to be noted that in this embodiment, not only the driving time sequence as shown in FIG. 7 may be used for driving, but also the driving time sequence as shown in FIG. 3 or FIG. 5 may be used for driving. When the driving time sequence as shown in FIG. 3 or FIG. 5 is used for driving, for example, transistors not enabled in the driving process may be correspondingly disconnected according to needs for the driving time sequence.

Figure 8:
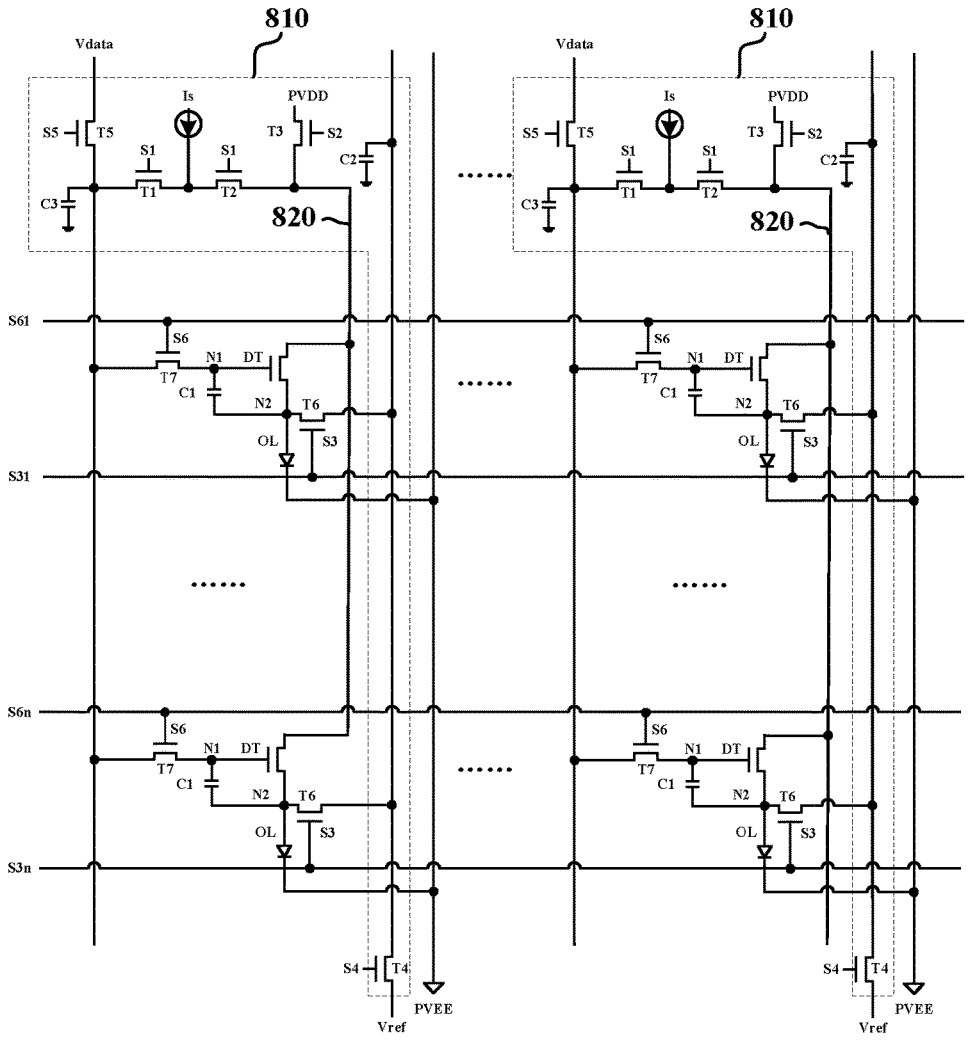
FIG. 8 illustrates a schematic structural diagram of an organic light emitting display panel according to another embodiment of the present disclosure.

Referring to FIG. 8, which is a schematic structural diagram of an organic light emitting display panel according to another embodiment of the present disclosure.

Similar to the organic light emitting display panel as shown in FIG. 1, the organic light emitting display panel of this embodiment likewise comprises a pixel array, a plurality of pixel driving circuits and a plurality of pixel compensation circuits 810.

Different from the embodiment as shown in FIG. 1, in the organic light emitting display panel of this embodiment, each pixel compensation circuit 810 is configured to acquire the anode voltage of the light emitting diode in each pixel driving circuit corresponding to the same column of pixel regions and the light emitting current flowing through the light emitting diode. That is, in the pixel array, each pixel driving circuit 810 in a certain column of pixel regions is electrically connected with the same pixel compensation circuit.

As thus, each pixel compensation circuit 810 may acquire, based on time sharing, the anode voltage of the light emitting diode in each pixel driving circuit electrically connected with the pixel compensation circuit 810 and the light emitting current flowing through the light emitting diode. When calculating a compensation signal, for example, the compensation signal may be respectively calculated for the driving transistor and the light emitting diode in each pixel region. Alternatively, an average value of the threshold voltages of the same column of driving transistors may be calculated and determined as the common threshold voltage of the column of driving transistors, and a common brightness-current curve of the column of light emitting diodes may be determined by synthesizing the brightness-current curves of the column of light emitting diodes.

By electrically connecting the same column of pixel driving circuits to the same pixel compensation circuit 810, the number of the pixel compensation circuits 810 may be reduced as much as possible under the premise of ensuring a pixel compensation effect, thereby reducing a layout area of the pixel compensation circuit 810 occupying the organic light emitting display panel. In another aspect, the pixel compensation circuit 810 generally is arranged in a non-display area of the organic light emitting display panel, and thus space occupied by the non-display area may be reduced, which is advantageous to implementation of narrow bezel of the organic light emitting display panel.

In addition, in some optional implementations, as shown in FIG. 8, the organic light emitting display panel of this embodiment further comprises a plurality of first voltage signal lines 820. Each first voltage signal line 820 is electrically connected with the first voltage signal terminal PVDD. Each pixel driving circuit corresponding to a column of pixel regions is electrically connected with the same first voltage signal line 820. By electrically connecting the same column of pixel driving circuits to the same first voltage signal line 820, the number of lines of the organic light emitting display panel may be further reduced, thereby reducing mutual interference among the lines and lifting a transmission speed of each signal line in transmitting a signal.

In addition, in some optional implementations, as shown in FIG. 8, each pixel driving circuit corresponding to a row of pixel regions is electrically connected with the same third control signal terminal, and each pixel driving circuit corresponding to a row of pixel regions is electrically connected with the same sixth control signal terminal.

For example, in FIG. 8, each pixel driving circuit corresponding to a first row of pixel regions is electrically connected with the same third control signal terminal S31, and each pixel driving circuit corresponding to a first row of pixel regions is electrically connected with the same sixth control signal terminal S61. Similarly, each pixel driving circuit corresponding to the $n^{th}$ row of pixel regions is electrically connected with the same third control signal terminal S3*n*, and each pixel driving circuit corresponding to the $n^{th}$ row of pixel regions is electrically connected with the same sixth control signal terminal S6*n*.

As thus, each pixel driving circuit in the same row of pixel regions may synchronously work, thereby implementing a row of pixels being lighted synchronously to emit light.

Further, when the same row of third control signal terminals S3 and sixth control signal terminals S6 output the same waveform (for example, when the driving time sequence as shown in FIG. 7 is adopted), in the same row of pixel regions, gates of the sixth transistor T6 and the seventh transistor T7 of each pixel driving circuit may share the same signal terminal, thereby reducing the number of drive signals required for the organic light emitting display panel and reducing the mutual interference among drive signal terminals.

Figure 9:
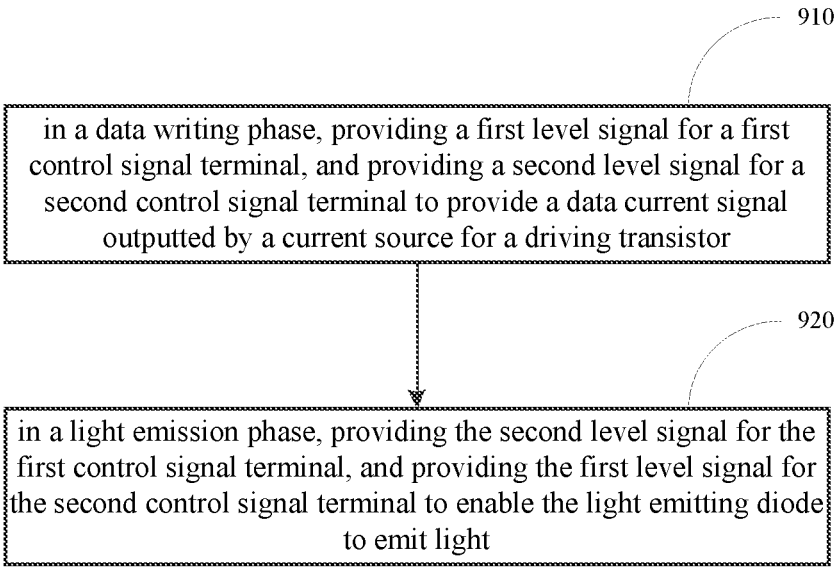
FIG. 9 illustrates a schematic flowchart of a driving method according to an embodiment of the present disclosure.

Referring to FIG. 9, FIG. 7 is a schematic flowchart of a driving method according to an embodiment of this application. The driving method of this embodiment may be applied to the organic light emitting display panel as described in any one of the above embodiments.

The driving method of this embodiment comprises following steps.

Step 910: in a data writing phase, providing a first voltage level signal for a first control signal terminal, and providing a second voltage level signal for a second control signal terminal to provide a data current signal outputted by a current source for a driving transistor.

Step 920: in a light emission phase, providing the second voltage level signal for the first control signal terminal, and providing the first voltage level signal for the second control signal terminal to allow the light emitting diode to emit light.

As thus, as long as the current source Is supplies light emitting current corresponding to each display gray scale to each pixel driving circuit via the pixel compensation circuit, the light emitting diode OL in each pixel driving circuit may be ensured to emit light of corresponding brightness, and the light emitting brightness may be merely related to the magnitude of the light emitting current supplied by the current source but unrelated to the threshold voltage of the driving transistor DT, the carrier mobility and the aging degree of the light emitting diode OL (namely, the I-V ratio of the light emitting diode OL). Therefore, no matter how the threshold voltage of each driving transistor DT in the organic light emitting display panel and the carrier mobility vary, and no matter what the aging degree of each light emitting diode OL in the organic light emitting display panel is, by using the circuit driving method of this embodiment, uniform display of each display brightness in each region of the organic light emitting display panel may be implemented, thereby enhancing the display brightness uniformity for the organic light emitting display panel.

Figure 10:
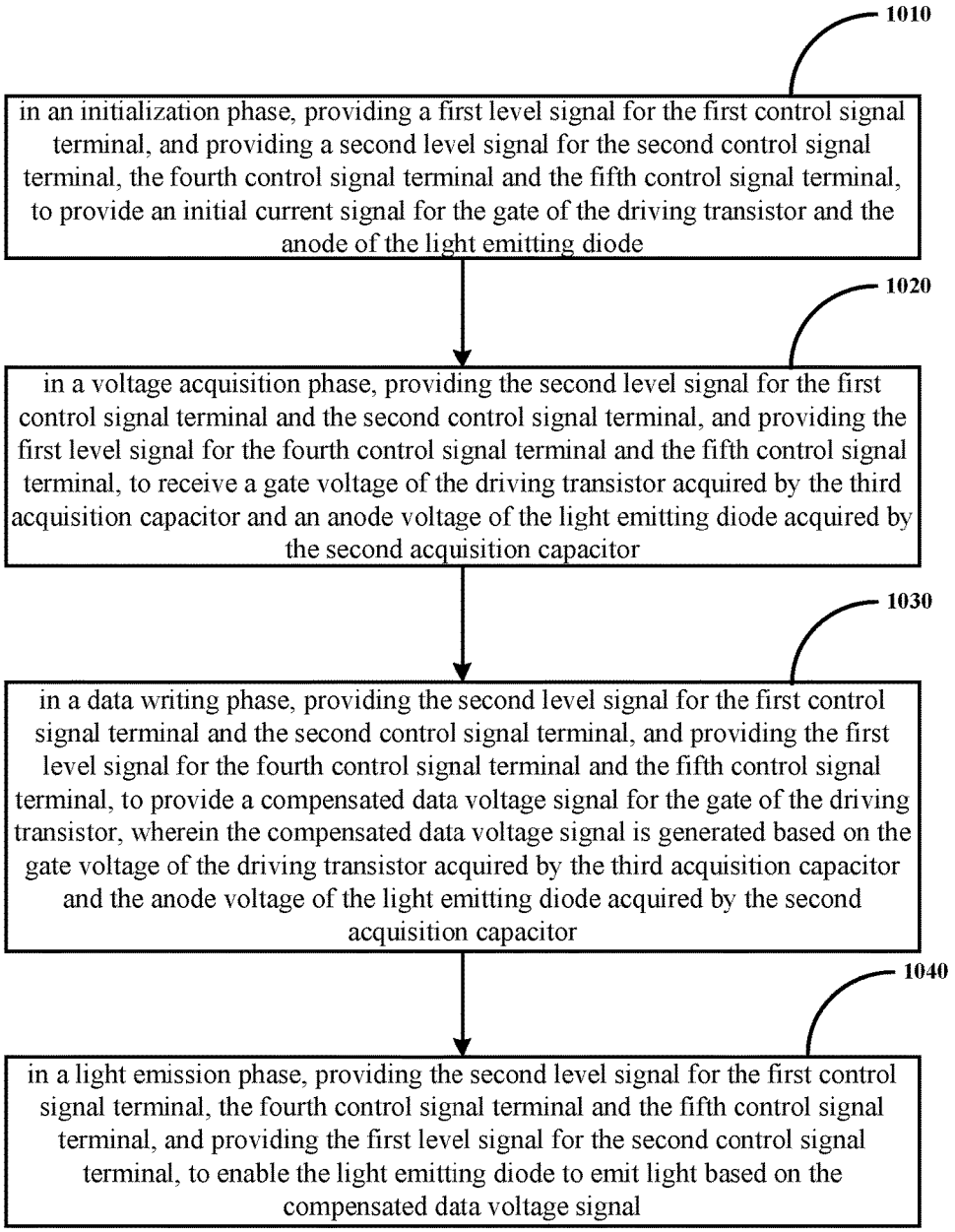
FIG. 10 illustrates a schematic flowchart of a driving method according to another embodiment of the present disclosure.

Referring to FIG. 10, which is a schematic flowchart of a method for driving an organic light emitting display panel according to another embodiment of the present disclosure. The driving method of this embodiment may be used for driving the organic light emitting display panel having the pixel driving circuit and the pixel compensation circuit as shown in FIG. 4.

The driving method of this embodiment comprises following steps.

Step 1010: in an initialization phase, providing a first voltage level signal for the first control signal terminal, and providing a second level signal for the second control signal terminal, the fourth control signal terminal and the fifth control signal terminal to provide an initial current signal for the gate of the driving transistor and the anode of the light emitting diode.

Step 1020: in a voltage acquisition phase, providing the second level signal for the first control signal terminal and the second control signal terminal, and providing the first level signal for the fourth control signal terminal and the fifth control signal terminal to receive a gate voltage of the driving transistor acquired by the third acquisition capacitor and an anode voltage of the light emitting diode acquired by the second acquisition capacitor.

Step 1030: in a data writing phase, providing the second level signal for the first control signal terminal and the second control signal terminal, and providing the first level signal for the fourth control signal terminal and the fifth control signal terminal to provide a compensated data voltage signal for the gate of the driving transistor, wherein the compensated data voltage signal is generated based on the gate voltage of the driving transistor acquired by the third acquisition capacitor and the anode voltage of the light emitting diode acquired by the second acquisition capacitor.

Step 1040: in a light emission phase, providing the second level signal for the first control signal terminal, the fourth control signal terminal and the fifth control signal terminal, and providing the first level signal for the second control signal terminal to allow the light emitting diode to emit light based on the compensated data voltage signal.

As thus, as can be seen from the structure as shown in FIG. 4, the current source Is of the pixel compensation circuit 410 may output a reference current signal to the node N1 and the node N2 of the pixel driving circuit. The voltage of the node N1 is acquired by the third acquisition capacitor C3, and the voltage of the node N2 is acquired by the second acquisition capacitor C2. A certain numerical relationship exists among the light emitting current, the difference Vgs between the gate voltage (namely, the voltage of the node N1) and the source voltage (namely, the voltage of the node N2) of the driving transistor DT, the carrier mobility of the driving transistor DT and the threshold voltage of the driving transistor DT, and the reference current signal outputted by the current source Is is a known numerical value. Therefore, by repeatedly acquiring the voltage of the node N1 and the voltage of the node N2, the carrier mobility and the threshold voltage of the driving transistor DT may be determined correspondingly. Meanwhile, the I (flow current)-V (anode voltage) ratio of the light emitting diode OL may be worked out by means of the voltage of the node N2 and the reference current signal outputted by the current source Is.

As can be seen from the above analysis, after the driving method of this embodiment is adopted, by acquiring the gate voltage (the voltage of the node N1) of the driving transistor DT and the anode voltage (the voltage of the node N2) of the light emitting diode OL, the pixel compensation circuit 410 may determine the current carrier mobility and the threshold voltage of the driving transistor DT and the I-V ratio of the light emitting diode OL in the pixel driving circuit in the event that the light emitting current (namely, the reference current outputted by the current source Is) flowing through the light emitting diode OL is known. As thus, a compensation signal may be determined according to the gate voltage (the voltage of the node N1) of the driving transistor DT, the anode voltage of the light emitting diode OL and the known light emitting current (namely, the reference current outputted by the current source Is) flowing through the light emitting diode OL. When a data voltage signal is applied to each pixel driving circuit, the data voltage signal applied to each pixel driving circuit is compensated by using the compensation signal, so as to enhance the display brightness uniformity for the whole organic light emitting display panel.

In addition, in some optional implementations, the driving method of this embodiment also may be used for driving the organic light emitting display panel having the pixel driving circuit and the pixel compensation circuit as shown in FIG. 6.

In these optional implementations, Step 1010 of this embodiment may further comprise: in an initialization phase, providing the first level signal for the third control signal terminal and the sixth control signal terminal.

Step 1020 of this embodiment may further comprise: in the voltage acquisition phase, providing the second level signal for the third control signal terminal and the sixth control signal terminal.

Step 1030 of this embodiment may further comprise: in the data writing phase, providing the first level signal for the third control signal terminal and the sixth control signal terminal.

Step 1040 of this embodiment may further comprise: in the light emission phase, providing the second level signal for the third control signal terminal and the sixth control signal terminal.

As thus, by providing a data voltage signal compensated by a compensation signal to the gate of the driving transistor in each pixel driving circuit, compensation of the threshold voltage of the driving transistor, the carrier mobility and aging of the light emitting diode may be implemented, thereby ensuring display brightness uniformity for the organic light emitting display panel in time dimension and space dimension.

Based on the above embodiments, the present application provides a plurality of pixel compensation circuits. The pixel circuit includes a current source signal terminal that provides a constant current source signal or a non-constant current signal, and an acquisition capacitor that acquires voltages of the gate and the source/drain of the driving transistor, so as to achieve compensation for the internal current or external current of the pixel driving circuit. Specifically, the current signal terminal provides a constant or non-constant current to the driving transistor in the pixel driving circuit, and the acquisition capacitor is connected to the gate or the source/drain of the driving transistor, so that compensation for the threshold voltage of the driving transistor, the carrier mobility and aging of the light emitting diode can be achieved.

In the above embodiments, each transistor is an NMOS transistor. In the following embodiments, the present application provides an embodiment in which a compensation function of the above-described driving circuit is implemented by means of a PMOS transistor.

Figure 12:
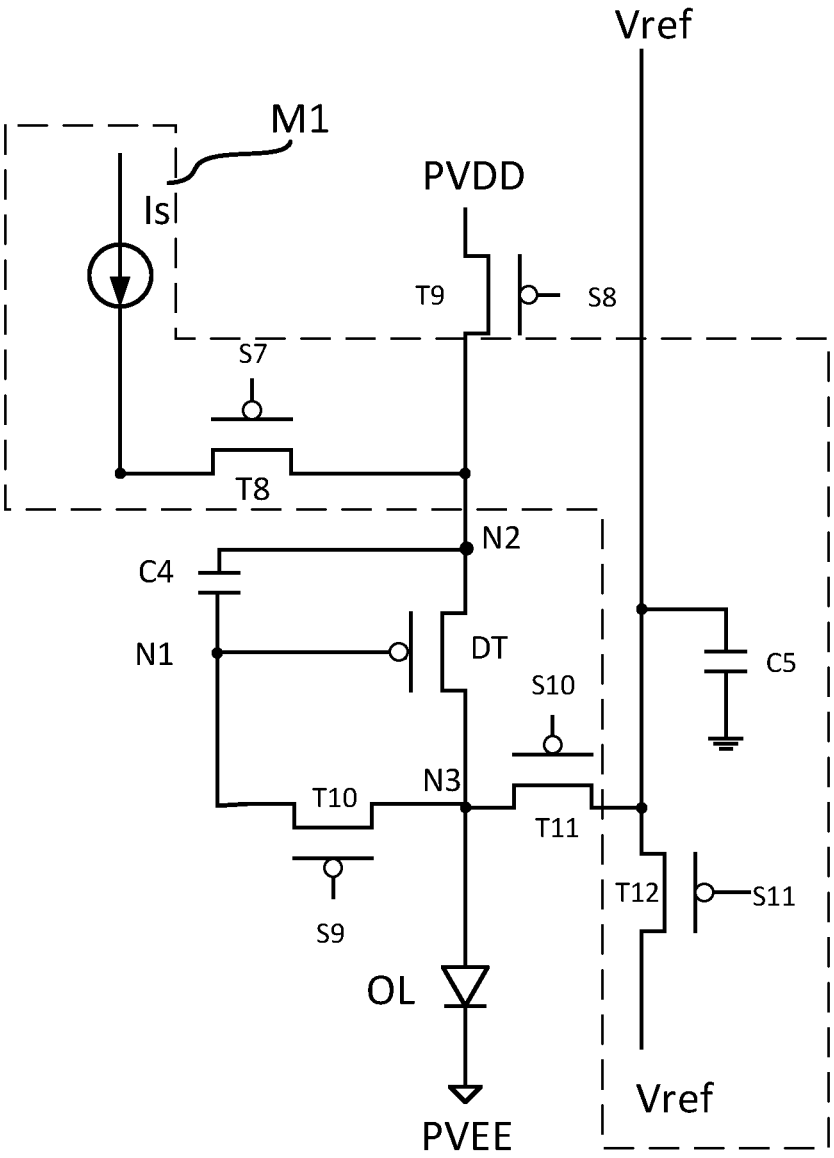
FIG. 12 illustrates a schematic structural diagram of an organic light emitting display panel according to still another embodiment of the present disclosure.
Figure 13:
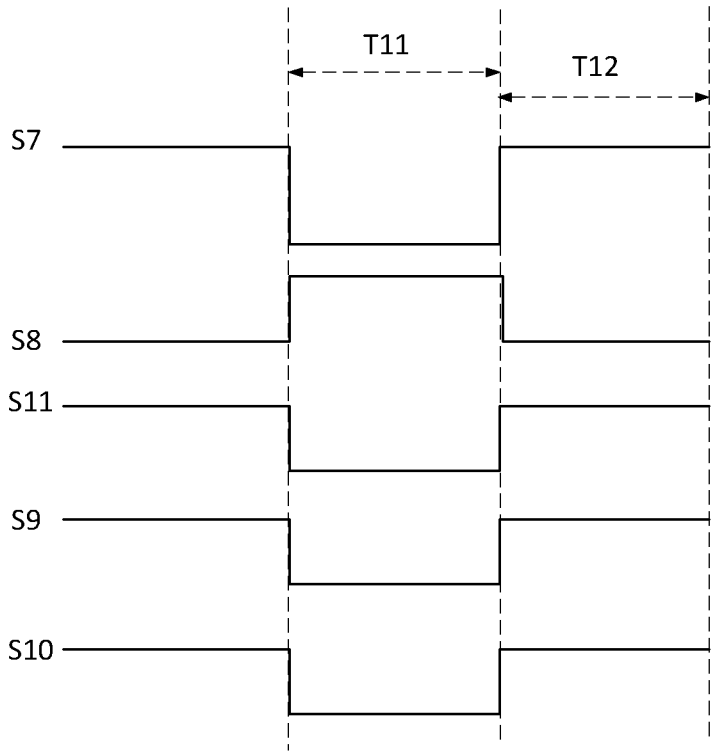
FIG. 13 illustrates a schematic timing sequence of each drive signal used in FIG. 12.

As shown in FIG. 12 to FIG. 13, an organic light emitting display panel is provided in an embodiment of the present application, including a pixel array, a plurality of pixel driving circuits (not shown), and a plurality of pixel compensation circuits M1 (as shown in the dashed line in FIG. 12).

FIG. 12 is a schematic diagram showing a connection relationship between a pixel driving circuit and a pixel compensation circuit M1 in an organic light emitting display panel according to an embodiment of the present application.

The pixel driving circuit includes a driving transistor DT, a ninth transistor T9, a tenth transistor T10, an eleventh transistor T11, and a fourth capacitor C4. The ninth transistor T9 and the tenth transistor T10 are switching transistors controlled by an external pulse enabling signal. The fourth capacitor C4 is a storage capacitance electrically connected to the gate of the driving transistor DT and used to maintain the voltage at the gate of the driving transistor DT.

The pixel compensation circuit M1 includes a current source signal terminal Is that provides a plurality of current signals with different gray scales to the driving transistor DT, an eighth transistor T8, a twelfth transistor T12, a fifth acquisition capacitor C5, and a fourth constant level signal terminal Vref.

The connection relationship between the pixel driving circuit and the pixel compensation circuit M1 will be specifically described in the following.

For the eighth transistor T8 in the pixel compensation circuit M1, the gate of the eighth transistor T8 is connected to the seventh signal terminal S7, the source of the eighth transistor T8 is connected to the current source signal terminal Is, and the drain of the eighth transistor T8 is connected to the source of the driving transistor DT. The seventh signal terminal S7 provides an enabling pulse signal to the gate of the eighth transistor T8 so as to control switch-on and switch-off of the eighth transistor T8. In this embodiment, all the transistors are PMOS transistors, and therefore, when the seventh signal terminal S7 provides a low voltage signal, the eighth transistor T8 is in a switch-on state, i.e., in an on state.

For the twelfth transistor T12 in the pixel compensation circuit M1: the gate of the twelfth transistor T12 is connected to the eleventh signal terminal S11, the source of the twelfth transistor T12 is connected to the fourth constant level signal terminal Vref, and the drain of the twelfth transistor T12 is connected to the fourth constant level signal terminal Vref. The eleventh signal terminal S11 provides an enabling pulse signal to the gate of the twelfth transistor T12 so as to control switch-on and switch-off of the twelfth transistor T12. In addition, the fourth constant signal terminal Vref provides a constant low level signal to the pixel compensation circuit M1, and a level of the constant low level signal is lower than a level at the cathode PVEE of the light emitting diode OL. In general, the level signal provided by the fourth constant signal terminal Vref is at least smaller than −5V.

For the fifth acquisition capacitor C5 in the pixel compensation circuit M1: a first end of the fifth acquisition capacitor C5 is connected to the fourth constant level signal terminal Vref, and a second end of the fifth acquisition capacitor C5 is grounded. In this embodiment, the second end of the fifth acquisition capacitor C5 can also be connected to an integrated circuit, as described in the corresponding embodiment above.

For the ninth transistor T9 in the pixel driving circuit: the gate of the ninth transistor T9 is connected to the eighth signal terminal S8, the source of the ninth transistor T9 is connected to the third constant voltage signal terminal PVDD, and the drain of the ninth transistor T9 is connected to the source of the driving transistor DT. The third constant voltage signal terminal PVDD provides a constant high voltage signal to the pixel driving circuit. The eighth signal terminal S8 provides an enabling pulse signal to the gate of the ninth transistor T9 so as to control switch-on and switch-off of the ninth transistor T9.

For the tenth transistor T10 in the pixel driving circuit: the gate of the tenth transistor T10 is connected to the ninth signal terminal S9, the source of the tenth transistor T10 is connected to the drain of the driving transistor DT, and the drain of the tenth transistor T10 is connected to the gate of the driving transistor DT. The ninth signal terminal S9 provides an enabling pulse signal to the gate of the tenth transistor T10 so as to control switch-on and switch-off of the tenth transistor T10.

For the eleventh transistor T11 in the pixel driving circuit: the gate of the eleventh transistor T11 is connected to the tenth signal terminal S10, the source of the eleventh transistor T11 is connected to the fourth constant level signal terminal Vref, and the drain of the eleventh transistor T11 is connected to the drain of the driving transistor DT. The tenth signal terminal S10 provides an enabling pulse signal to the gate of the eleventh transistor T11 so as to control switch-on and switch-off of the eleventh transistor T11.

For the fourth capacitor C4 in the pixel driving circuit: a first end of the fourth capacitor C4 is connected to the source of the driving transistor DT, and a second end of the fourth capacitor C4 is connected to the gate of the driving transistor DT.

Figure 16:
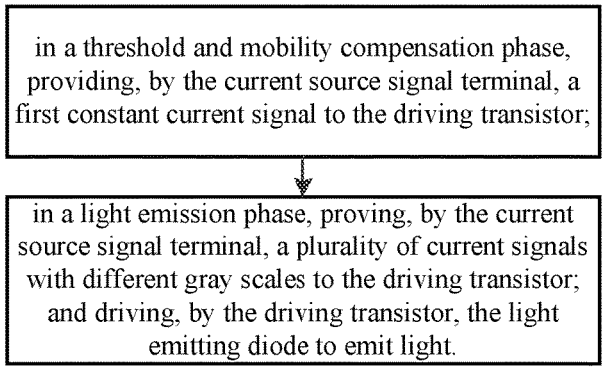
FIG. 16 illustrates a schematic flowchart of a driving method according to still another embodiment of the present disclosure.

For the display panel in the above embodiments, as shown in FIG. 13 and FIG. 16, the present application further provides a corresponding driving method.

The driving method includes two phases, i.e., a threshold and mobility compensation phase T11 and a light emission phase T12. The two phases will be described in the following.

In the threshold and mobility compensation phase T11, the current source signal terminal Is provides a first constant current signal to the driving transistor DT. Specifically, in this phase, the seventh signal terminal S7, the eleventh signal terminal S11, the ninth signal terminal S9, and the tenth signal terminal S10 provide a low voltage signal to the corresponding transistors, so that the corresponding eighth transistor T8, the twelfth transistor T12, the tenth transistor T10, and the eleventh transistor T11 are in an on state. The first constant current signal provided by the current source signal terminal Is flows from the eighth transistor T8 to the node N1 and the node N2, i.e., flowing into the source and gate of the driving transistor DT. Moreover, the level at the fourth constant level signal terminal Vref at this time is much lower than the level at the cathode PVEE of the light emitting diode OL. Therefore, the first current signal flows to the fourth constant level signal terminal Vref rather than flowing to the cathode PVEE of the light emitting diode OL.

When the first constant current Is is stabilized, the node N1 will be in a steady state due to the holding action of the fourth capacitor C4, that is, no more current will flow through it. At this time, the first constant current Is all flows into the source/drain of the driving transistor DT. Therefore, at this time, the driving current generated in the driving transistor DT is the first constant current I1, where $I1=K(Vgs-Vth)^2$.

At this time, the voltage difference between the node N1 and the node N2 is the threshold voltage Vth of the driving transistor, thereby achieving the compensation for the threshold Vth and mobility of the driving transistor DT.

In the light emission phase T12, the first voltage value of the gate of the driving transistor DT varies synchronously with the second voltage value of the source of the driving transistor DT. Specifically, in this phase, the eighth signal terminal S8 provides a low voltage signal to the corresponding ninth transistor T9, so that the second transistor T9 is in an on state. The seventh signal terminal S7, the eleventh signal terminal S11, the ninth signal terminal S9, and the tenth signal terminal S10 provide a high voltage signal to the corresponding transistor, so that the corresponding transistor is in an off state.

In this phase, the third constant voltage signal terminal PVDD provides a constant high level signal to the node N2, the level of the node N2 is raised, and the node N1 is in a suspension state. However, since a fourth capacitor C4 is arranged between the node N1 and the node N2, the level at the node N1 changes synchronously with the level at the node N2, and the voltage difference between the two does not change, that is, the first voltage value of the gate of the driving transistor changes synchronously with the second voltage value of the source of the driving transistor DT. In addition, since the eighth transistor T8, the twelfth transistor T12, the tenth transistor T10, and the eleventh transistor T11 are in an off state, the current in the driving transistor DT at this time will flow to the light emitting diode OL, and the third constant voltage signal terminal PVDD at this time provides a constant high voltage to the pixel circuit, so that the light emitting diode OL can emit light. In addition, in the light emission phase T12, the current signal terminal Is provides corresponding current signals with gray scales of 0-255 (i.e., a total of 256 different gray scales) to the driving transistor DT, thereby achieving internal compensation with respect to the driving transistor.

Based on the above embodiments, the present application further provides another embodiment.

Figure 14:
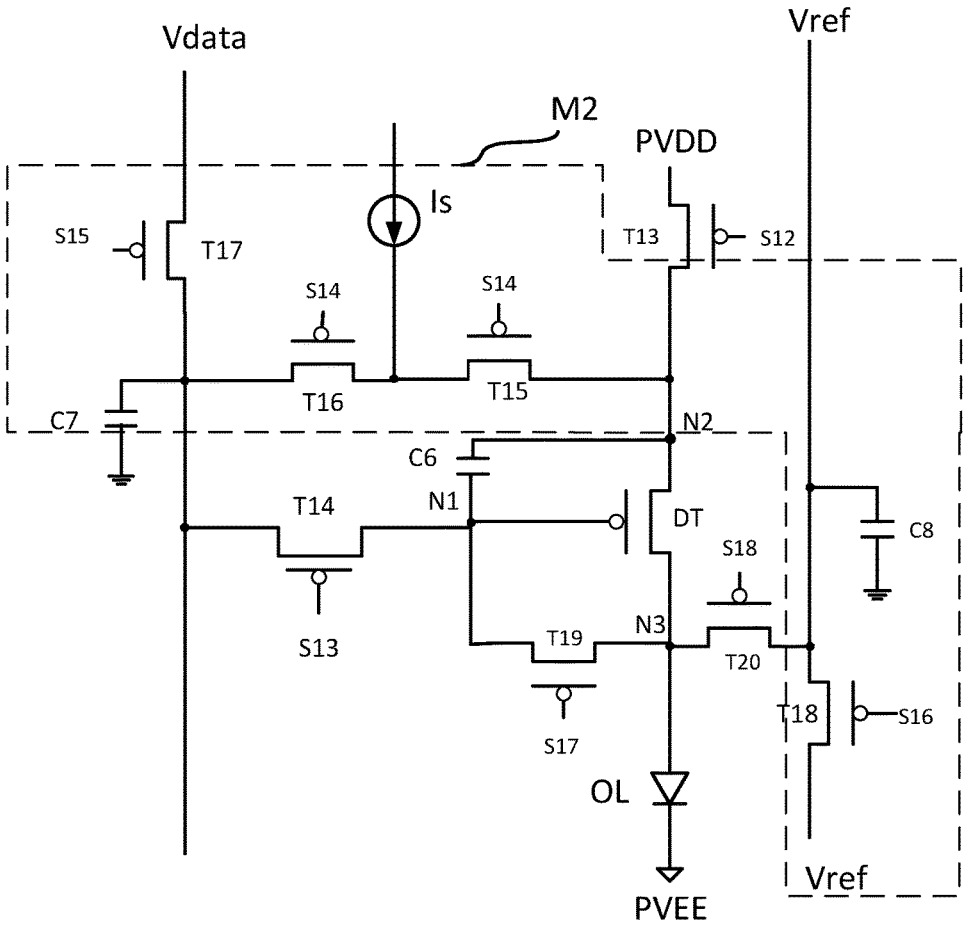
FIG. 14 illustrates a schematic structural diagram of an organic light emitting display panel according to another embodiment of the present disclosure.
Figure 15:
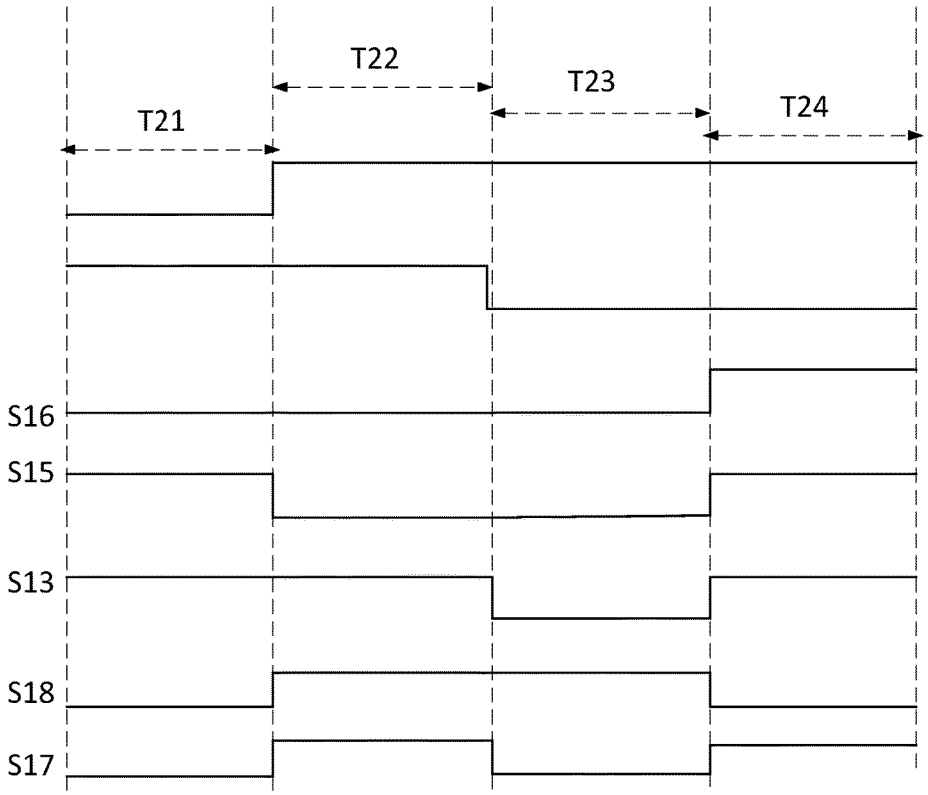
FIG. 15 illustrates a schematic timing sequence of each drive signal used in FIG. 14.

As shown in FIG. 14 and FIG. 15, an organic light emitting display panel is provided in an embodiment of the present application, including a pixel array, a plurality of pixel driving circuits (not shown), and a plurality of pixel compensation circuits M2 (as shown in the dashed line in FIG. 14).

FIG. 14 is a schematic diagram showing a connection relationship between a pixel driving circuit and a pixel compensation circuit M2 in an organic light emitting display panel according to an embodiment of the present application.

The pixel driving circuit includes a second data signal terminal Vdata, a fifth constant signal terminal Vref, a driving transistor DT, a thirteenth transistor T13, a fourteenth transistor T14, a nineteenth transistor T19, a twentieth transistor T20, and a sixth capacitor C6. The thirteenth transistor T13, the fourteenth transistor T14, the nineteenth transistor T19, and the twentieth transistor T20 are switching transistors controlled by an external pulse enabling signal. The sixth capacitor C6 is a storage capacitor electrically connected to the gate of the driving transistor DT and used to maintain the voltage at the gate of the driving transistor DT.

The pixel compensation circuit M2 includes a current source signal terminal Is that provides a constant current signal to the driving transistor DT, a fifteenth transistor T15, a sixteenth transistor T16, a seventeenth transistor T17, an eighteenth transistor T18, a seventh acquisition capacitor C7, and an eighth acquisition capacitor C8.

The connection relationship between the pixel driving circuit and the pixel compensation circuit M2 will be specifically described in the following.

For the second data signal terminal Vdata in the pixel compensation circuit M2: the second data signal terminal Vdata outputs a data voltage signal to the driving transistor DT, and the second data signal terminal Vdata feeds back a voltage signal of the source of the driving transistor DT to the pixel compensation circuit M2.

For the fifth constant signal terminal Vref in the pixel compensation circuit M2: the fifth constant signal terminal Vref outputs a reset signal (generally a low level signal) to the anode of the light emitting diode OL, and the fifth constant signal terminal Vref feeds back the voltage signal of the gate of driving transistor DT to the pixel compensation circuit M2. The fifth constant level signal terminal Vref provides a constant low level signal (generally smaller than −5V) to the pixel compensation circuit M2, and the level of the constant low level signal is lower than the level at the cathode PVEE of the light emitting diode OL.

For the thirteenth transistor T13 in the pixel driving circuit: the gate of the thirteenth transistor T13 is connected to the twelfth signal terminal S12, the source of the thirteenth transistor T13 is connected to the sixth constant voltage signal terminal PVDD (providing a constant high level signal to the pixel driving circuit), and the drain of the thirteenth transistor T13 is connected to the source of the driving transistor DT. The twelfth signal terminal S12 provides an enabling pulse signal to the gate of the thirteenth transistor T13 so as to control switch-on and switch-off of the thirteenth transistor T13. In this embodiment, all transistors are PMOS transistors, and therefore, when the twelfth signal terminal S12 provides a low voltage signal, the thirteenth transistor T13 is in a switch-on state, i.e., in an on state.

For the fourteenth transistor T14 in the pixel driving circuit: the gate of the fourteenth transistor T14 is connected to the thirteenth signal terminal S13, the source of the fourteenth transistor is connected to the second data signal terminal Vdata, and the drain of the fourteenth transistor is connected to the gate of the driving transistor DT.

For the nineteenth transistor T19 in the pixel driving circuit: the gate of the nineteenth transistor T19 is connected to the seventeenth signal terminal S17, a source of the nineteenth transistor is connected to the gate of the driving transistor DT, and the drain of the fourteenth transistor is connected to the drain of the driving transistor DT. The seventeenth signal terminal S17 provides an enabling pulse signal to the gate of the nineteenth transistor T19 so as to control switch-on and switch-off of the nineteenth transistor T19.

For the twentieth transistor T20 in the pixel driving circuit: the gate of the twentieth transistor T20 is connected to the eighteenth signal terminal S18, the source of the twentieth transistor is connected to the fifth constant signal terminal Vref, and the drain of the twentieth transistor is connected to the drain of the driving transistor DT. The eighteenth signal terminal S18 provides an enabling pulse signal to the gate of the twentieth transistor T20 so as to control switch-on and switch-off of the twentieth transistor T20.

For the sixth capacitor C6 in the pixel driving circuit: a first end of the sixth capacitor C6 is connected to the source of the driving transistor DT, and a second end of the sixth capacitor C6 is connected to the gate of the driving transistor DT.

For the fifteenth transistor T15 in the pixel compensation circuit M2: the gate of the fifteenth transistor T15 is connected to the fourteenth signal terminal S14, the source of the fifteenth transistor T15 is connected to the sixth constant voltage signal terminal PVDD, and the drain of the fifteenth transistor T15 is connected to the current source signal terminal Is. The fourteenth signal terminal S14 provides an enabling pulse signal to the gate of the fifteenth transistor T15 so as to control switch-on and switch-off of the fifteenth transistor T15.

For the sixteenth transistor T16 in the pixel compensation circuit M2: the gate of the sixteenth transistor T16 is connected to the fourteenth signal terminal S14, the source of the sixteenth transistor T16 is connected to the current source signal terminal Is, and the drain of the sixteenth transistor T16 is connected to the second data signal terminal Is. The fourteenth signal terminal S14 provides an enabling pulse signal to the gate of the sixteenth transistor T16 so as to control switch-on and switch-off of the sixteenth transistor T16.

For the seventeenth transistor T17 in the pixel compensation circuit M2: the gate of the seventeenth transistor T17 is connected to the fifteenth signal terminal S15, the source of the seventeenth transistor is connected to the second data signal terminal Vdata, and the drain of the seventeenth transistor T17 is connected to the first end of the seventh acquisition capacitor C7. The fifteenth signal terminal S15 provides an enabling pulse signal to the gate of the seventeenth transistor T17 so as to control switch-on and switch-off of the seventeenth transistor T17.

For the eighteenth transistor T18 in the pixel compensation circuit M2: the gate of the eighteenth transistor T18 is connected to the sixteenth signal terminal S16, the source of the eighteenth transistor T18 is connected to the fifth constant voltage signal terminal Vref, and the drain of the eighteen transistor T18 is connected to a first end of the eighth acquisition capacitor C8. The sixteenth signal terminal S16 provides an enabling pulse signal to the gate of the eighteenth transistor T18 so as to control switch-on and switch-off of the eighteenth transistor T18.

For the seventh acquisition capacitor C7 and the eighth acquisition capacitor C8 in the pixel compensation circuit M2: a second end of the seventh acquisition capacitor C7 is grounded. In this embodiment, the second end of the seventh acquisition capacitor C7 can also be connected to an integrated circuit, as described in the corresponding embodiments above.

A second end of the eighth acquisition capacitor C8 is grounded. In this embodiment, the second end of the eighth acquisition capacitor C8 can also be connected to an integrated circuit, as described in the corresponding embodiments above.

Figure 17:
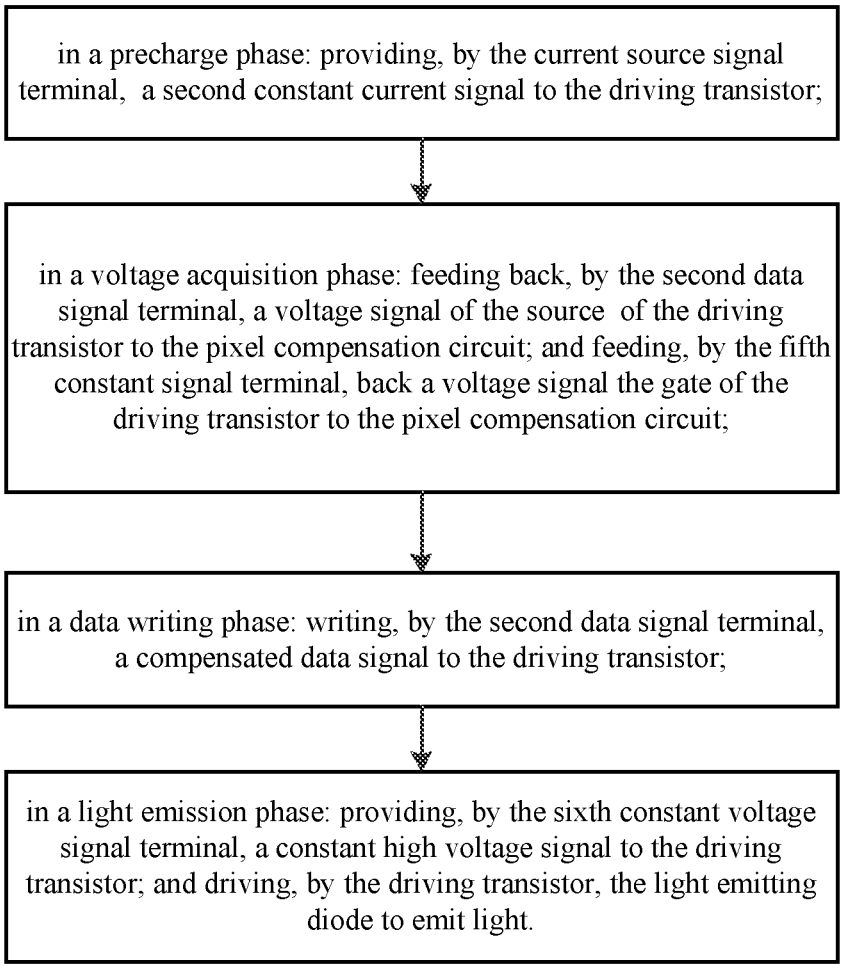
FIG. 17 illustrates a schematic flowchart of a driving method according to still another embodiment of the present disclosure.

For the display panel in the above embodiments, the present application further provides a corresponding driving method, as shown in FIG. 15 and FIG. 17.

The driving method includes four phases, i.e., a precharge phase T21, a voltage acquisition phase T22, a data writing phase T23, and a light emission phase T24. The four phases will be described accordingly in the following.

In the precharge phase T21: the current source signal terminal provides a second constant current signal to the driving transistor. Specifically, in this phase, the fourteenth signal terminal S14, the sixteenth signal terminal S16, the eighteenth signal terminal S18, and the seventeenth signal terminal S17 provide a low voltage signal to the corresponding transistor, so that the corresponding fifteenth transistor T15, the sixteenth transistor T16, the eighteenth transistor T18, the twentieth transistor T20, and the nineteenth transistor T19 are in an on state. The second constant current signal I2 provided by the current source signal terminal Is respectively flows to the node N1 and the node N2, that is, flowing into the source and gate of the driving transistor DT. Moreover, the level of the fifth constant level signal terminal Vref at this time is much smaller than the level at the cathode PVEE of the light emitting diode OL. Therefore, the second current signal flows to the fifth constant level signal terminal Vref rather than flowing to the cathode PVEE of the light emitting diode OL.

When the second constant current I2 is stabilized, the node N1 will be in a steady state due to the holding action of the sixth capacitor C6, that is, no more current will flow through it. At this time, the first constant current Is all flows into the source/drain of the driving transistor DT. At this time, the voltage difference between the node N1 and the node N2 is the threshold voltage Vth of the driving transistor, and the level at the gate of the driving transistor DT is VN1 and the level at the source of the driving transistor DT is VN2.

In the voltage acquisition phase T22, the second data signal terminal Vdata feeds back the voltage signal of the source of the driving transistor DT to the pixel compensation circuit M2, and the fifth constant signal terminal Vref feeds back the voltage signal of the gate of the driving transistor to the pixel compensation circuit M2. Specifically, in this phase, the sixteenth signal terminal S16 and the fifteenth signal terminal S15 provide a low voltage signal to the corresponding transistors, so that the corresponding eighteenth transistor T18 and the seventeenth transistor T17 are in an on state. At this time, the seventh acquisition capacitor C7 maintains at the level of the node N1 at the previous moment, that is, the level VN1 at the gate of the driving transistor DT, and the eighth acquisition capacitor C8 maintains at the level of the node N2 at the previous moment, that is, the level VN2 at the source/drain of the driving transistor DT. At this time, the level of the node N1 and the level of the node N2 are acquired by the second data signal terminal Vdata and the fifth constant signal terminal Vref, respectively.

Through two precharge phases and voltage acquisition phases, that is, the current source Is outputs two different reference current signals, and the seventh acquisition capacitor C7 and the eighth acquisition capacitor C8 acquire the level VN1 at the node N1 and the level VN2 at the node N2 twice. In this way, two equations in regard to the carrier mobility μ of the driving transistor DT and the threshold voltage Vth of the driving transistor DT can be obtained. Based on the simultaneous equations, the carrier mobility μ of the driving transistor DT and the threshold voltage Vth of the driving transistor DT can be worked out. For a specific explanation of the principle, reference can be made to the corresponding description in the above embodiments.

In the data writing phase T23, the second data signal terminal Vdata writes the compensated data signal Vdata' to the driving transistor DT. Specifically, in this phase, the twelfth signal terminal S12, the sixteenth signal terminal S16, the fifteenth signal terminal S15, the thirteenth signal terminal S13, and the seventeenth signal terminal S17 provide a low voltage signal to the corresponding transistors, so that the corresponding thirteenth transistor T13, the eighteenth transistor T18, the seventeenth transistor T17, the fourteenth transistor T14, and the nineteenth transistor T19 are in an on state. At this time, the second data signal terminal Vdata writes the compensated data signal Vdata' to the gate of the driving transistor DT; the fifth constant signal terminal Vref writes a low voltage signal to the drain of the driving transistor, i.e., the N3 node, and then the low level signal, as a reset signal, can be used to reset the anode of the light-emitting diode OL.

In the light emission phase T24: the sixth constant voltage signal terminal PVDD provides a constant high voltage signal to the driving transistor DT, and the driving transistor DT drives the light emitting diode OL to emit light. Specifically, in this phase, the twelfth signal terminal S12 provides a low voltage signal to the corresponding transistor, so that the corresponding thirteenth transistor T13 is in an on state. At this time, the driving current generated in the driving transistor DT flows to the light emitting diode OL, and at this time, the sixth constant voltage signal terminal PVDD provides a constant high voltage to the pixel circuit, thereby enabling the light emitting diode OL to emit light.

According to the present disclosure, the final light emitting current can be unrelated to the threshold voltage of the driving transistor, the carrier mobility and aging of the light emitting diode, thereby ensuring display brightness uniformity for the organic light emitting display panel in time dimension and space dimension.

Figure 11:
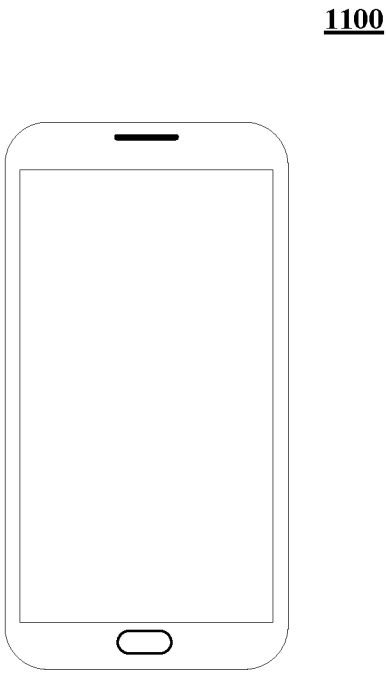
FIG. 11 illustrates a schematic structural diagram of an organic light emitting display apparatus according to the present disclosure.

The present disclosure further provides an organic light emitting display apparatus, as shown in FIG. 11, the organic light emitting display apparatus 1100 comprises the organic light emitting display panel according to the foregoing embodiments, which may be a mobile phone, a tablet computer and a wearable device, etc. It is to be understood that the organic light emitting display apparatus 1100 may further comprise known structures such as an encapsulation film and protective glass, which is not unnecessarily described herein.

The organic light emitting display panel disclosed in each embodiment of the present disclosure not only may be applied to a top-emitting organic light emitting display apparatus, but also may be applied to a bottom-emitting organic light emitting display apparatus. Therefore, the organic light emitting display apparatus of the present disclosure may be a top-emitting organic light emitting display apparatus or a bottom-emitting organic light emitting display apparatus.

It should be appreciated by those skilled in the art that the inventive scope of the present disclosure is not limited to the technical solutions formed by the particular combinations of the above technical features. The inventive scope should also cover other technical solutions formed by any combinations of the above technical features or equivalent features thereof without departing from the concept of the invention, such as, technical solutions formed by replacing the features as disclosed in the present disclosure with (but not limited to), technical features with similar functions.

What is claimed is:

1. An organic light emitting display panel, comprising:

a pixel array, comprising pixel regions in M rows and N columns;

a plurality of pixel driving circuits each comprising a light emitting diode and a driving transistor, the light emitting diode being arranged in each of the pixel regions; and a plurality of pixel compensation circuits, each comprising a current source signal terminal and an acquisition capacitor;

wherein the current source signal terminal provides a current signal to the driving transistor;

wherein the acquisition capacitor is electrically connected to the drive transistor, wherein the current signal comprises a plurality of current signals with different gray scales;

wherein the plurality of pixel compensation circuits each further comprises an eighth transistor having a gate connected to a seventh signal terminal, a source connected to the current source signal terminal, and a drain connected to a source of the driving transistor;

wherein the plurality of pixel driving circuits each further comprises a ninth transistor, a tenth transistor, and a fourth capacitor;

wherein the ninth transistor has a gate connected to an eighth signal terminal, a source connected to a third constant voltage signal terminal, and a drain connected to the source of the driving transistor;

wherein the tenth transistor has a gate connected to a ninth signal terminal, a source connected to a drain of the driving transistor, and a drain connected to a gate of the driving transistor; and wherein the fourth capacitor has a first end connected to the source of the driving transistor and a second end connected to the gate of the driving transistor.

2. The organic light emitting display panel according to claim 1, wherein each of the plurality of pixel compensation circuits further comprises a twelfth transistor, a fifth acquisition capacitor, and a fourth constant level signal terminal, wherein the twelfth transistor has a gate connected to an eleventh signal terminal, a source connected to the fourth constant level signal terminal, and a drain connected to the fourth constant level signal terminal, and wherein the fifth acquisition capacitor has a first end connected to the fourth constant level signal terminal and a second end that is grounded.

3. The organic light emitting display panel according to claim 2, wherein each of the plurality of pixel driving circuits further comprises an eleventh transistor, wherein the eleventh transistor has a gate connected to a tenth signal terminal, a source connected to the fourth constant level signal terminal, and a drain connected to the drain of the driving transistor, and wherein the fourth constant level signal terminal provides a constant low level signal to a respective one of the plurality of pixel compensation circuits, and a level of the constant low level signal is lower than a level at a cathode of the light emitting diode.

4. A driving method of an organic light-emitting display panel, applicable to drive the organic light-emitting display panel according to claim 1, wherein the method comprises:

in a threshold and mobility compensation phase, providing, by the current source signal terminal, a first constant current signal to the driving transistor; and in a light emission phase, proving, by the current source signal terminal, a plurality of current signals with different gray scales to the driving transistor; and driving, by the driving transistor, the light emitting diode to emit light.

5. The driving method according to claim 4, wherein in the light emission phase, a first voltage value of a gate of the driving transistor varies synchronously with a second voltage value of a source of the driving transistor.

6. An organic light emitting display panel, comprising:

a pixel array, comprising pixel regions in M rows and N columns;

a plurality of pixel driving circuits each comprising a light emitting diode and a driving transistor, wherein the light emitting diode in each of the plurality of pixel driving circuits is arranged in one of the pixel regions; and a plurality of pixel compensation circuits, each comprising a current source signal terminal and an acquisition capacitor;

wherein the current source signal terminal provides a current signal to the driving transistor, and wherein the acquisition capacitor is electrically connected to the drive transistor;

wherein the current signal comprises a constant current signal;

wherein the plurality of pixel driving circuits each further comprises a second data signal terminal and a fifth constant signal terminal;

wherein the second data signal terminal outputs a data voltage signal to the driving transistor, and the second data signal terminal feeds back a voltage signal of a source of the driving transistor to a respective one of the plurality of pixel compensation circuits;

wherein the fifth constant signal terminal outputs a reset signal to an anode of the light emitting diode, and the fifth constant signal terminal feeds back a voltage signal of a gate of the driving transistor to a respective one of the plurality of pixel compensation circuits;

wherein each of the plurality of pixel driving circuits further comprises a thirteenth transistor, a fourteenth transistor, and a sixth capacitor;

wherein the thirteenth transistor has a gate connected to a twelfth signal terminal, a source connected to a sixth constant voltage signal terminal, and a drain connected to the source of the driving transistor;

wherein the fourteenth transistor has a gate connected to a thirteenth signal terminal, a source connected to the second data signal terminal, and a drain connected to the gate of the driving transistor; and wherein the sixth capacitor has a first end connected to the source of the driving transistor and a second end connected to the gate of the driving transistor.

7. The organic light emitting display panel according to claim 6, wherein each of the plurality of pixel compensation circuits further comprises a fifteenth transistor and a sixteenth transistor, wherein the fifteenth transistor has a gate connected to a fourteenth signal terminal, a source connected to the sixth constant voltage signal terminal, and a drain connected to the current source signal terminal, and wherein the sixteenth transistor has a gate connected to the fourteenth signal terminal, a source connected to the current source signal terminal, and a drain connected to the second data signal terminal.

8. The organic light emitting display panel according to claim 7, wherein each of the plurality of pixel compensation circuits further comprises a seventeenth transistor, an eighteenth transistor, a seventh acquisition capacitor, and an eighth acquisition capacitor, wherein the seventeenth transistor has a gate connected to a fifteenth signal terminal, a source connected to the second data signal terminal, and a drain connected to a first end of the seventh acquisition capacitor, wherein the eighteenth transistor has a gate connected to a sixteenth signal terminal, a source connected to the fifth constant voltage signal terminal, and a drain connected to a first end of the eighth acquisition capacitor, wherein a second end of the seventh acquisition capacitor is grounded, and wherein a second end of the eighth acquisition capacitor is grounded.

9. The organic light emitting display panel according to claim 8, wherein the fifth constant level signal terminal provides a constant low level signal to a respective one of the plurality of pixel compensation circuits, and a level of the constant low level signal is lower than a level at a cathode of the light emitting diode.

10. A driving method of an organic light-emitting display panel, applicable to drive the organic light-emitting display panel according to claim 6, wherein the method comprises:

in a precharge phase, proving, by the current source signal terminal, a second constant current signal to the driving transistor;

in a voltage acquisition phase, feeding back, by the second data signal terminal, a voltage signal of a source of the driving transistor to a respective one of the plurality of pixel compensation circuits; feeding back, by the fifth constant signal terminal, a voltage signal of a gate of the driving transistor to a respective one of the plurality of pixel compensation circuits;

in a data writing phase, writing, by the second data signal terminal, a compensated data signal to the driving transistor; and in a light emission phase, providing, by the sixth constant voltage signal terminal, a constant high voltage signal to the driving transistor; and driving, by the driving transistor, the light emitting diode to emit light.

11. The driving method according to claim 10, wherein in the data writing phase, the fifth constant signal terminal outputs a reset signal to an anode of the light emitting diode, so as to reset the anode of the light emitting diode.

* * * * *